US007101622B2

(12) United States Patent
Chang et al.

(10) Patent No.: US 7,101,622 B2
(45) Date of Patent: Sep. 5, 2006

(54) PROPYLENE-BASED COPOLYMERS, A METHOD OF MAKING THE FIBERS AND ARTICLES MADE FROM THE FIBERS

(75) Inventors: Andy C. Chang, Houston, TX (US); Hong Peng, Lake Jackson, TX (US); Jozef J. I. Van Dun, Bellaire, TX (US); Randy E. Pepper, Lake Jackson, TX (US); Edward N. Knickerbocker, Lake Jackson, TX (US); Antonios K. Doufas, Lake Jackson, TX (US); Rajen M. Patel, Lake Jackson, TX (US); Lizhi Liu, Lake Jackson, TX (US); Byron P. Day, Canton, GA (US); Stephen M. Englebert, Woodstock, GA (US); Joy F. Jordan, Marietta, GA (US); Renette E. Richard, Dunwoody, GA (US); Christian L. Sanders, Decatur, GA (US); Varunesh Sharma, Atlanta, GA (US)

(73) Assignee: Dow Global Technologies Inc., Midland, MI (US)

( * ) Notice: Subject to any disclaimer, the term of this patent is extended or adjusted under 35 U.S.C. 154(b) by 0 days.

(21) Appl. No.: 11/083,891

(22) Filed: Mar. 18, 2005

(65) Prior Publication Data

US 2005/0244638 A1 Nov. 3, 2005

Related U.S. Application Data

(60) Provisional application No. 60/554,664, filed on Mar. 19, 2004.

(51) Int. Cl.
*D01F 6/00* (2006.01)

(52) U.S. Cl. ..... 428/364; 428/357

(58) Field of Classification Search ..... 428/357, 428/364
See application file for complete search history.

(56) References Cited

U.S. PATENT DOCUMENTS

| | | | |
|---|---|---|---|
| 3,423,255 | A | 1/1969 | Joyce |
| 3,485,706 | A | 12/1969 | Evans |
| 3,520,861 | A | 7/1970 | Thomson et al. |
| 3,692,618 | A | 9/1972 | Dorschner et al. |
| 3,802,817 | A | 4/1974 | Matsuki et al. |

(Continued)

FOREIGN PATENT DOCUMENTS

| | | | |
|---|---|---|---|
| EP | 0515203 | A2 | 5/1992 |

(Continued)

OTHER PUBLICATIONS

D.M. Bigg,Effect of Copolymer Ration on the Crystallinity and Properties of Polylactic Acid Copolymers, ANTEC'96, pp. 2028-2039.

(Continued)

*Primary Examiner*—N. Edwards

(57) ABSTRACT

Fibers that exhibit good elasticity or extensibility and tenacity, and low modulus are prepared from propylene-based copolymers. The propylene-based copolymers comprise at least about 50 weight percent (wt %) of units derived from propylene and at least about 8 wt % of units derived from one or more comonomers other than propylene, e.g., ethylene. Particularly preferred propylene copolymers are characterized as having $^{13}C$ NMR peaks corresponding to a regio-error at about 14.6 and about 15.7 ppm, the peaks of about equal intensity. In one aspect of the invention, fibers are subjected to stress-induced crystallization by subjecting the fiber to tensile elongation during draw.

26 Claims, 9 Drawing Sheets

Immediate Set and Retained Load at 30% Strain in 50% 1-Cycle test.

U.S. PATENT DOCUMENTS

| | | | |
|---|---|---|---|
| 3,849,241 | A | 11/1974 | Butin et al. |
| 4,322,027 | A | 3/1982 | Reba |
| 4,340,563 | A | 7/1982 | Appel et al. |
| 4,381,781 | A | 5/1983 | Sciaraffa et al. |
| 4,430,563 | A | 2/1984 | Harrington |
| 4,599,392 | A | 7/1986 | McKinney et al. |
| 4,663,220 | A | 5/1987 | Wisneski et al. |
| 4,668,566 | A | 5/1987 | Braun |
| 4,741,941 | A | 5/1988 | Englebert et al. |
| 4,939,016 | A | 7/1990 | Radwanski et al. |
| 4,988,781 | A | 1/1991 | McKinney et al. |
| 5,108,820 | A | 4/1992 | Kaneko et al. |
| 5,188,885 | A | 2/1993 | Timmons et al. |
| 5,272,236 | A | 12/1993 | Lai et al. |
| 5,278,272 | A | 1/1994 | Lai et al. |
| 5,322,728 | A | 6/1994 | Davey et al. |
| 5,336,552 | A | 8/1994 | Strack et al. |
| 5,352,518 | A | 10/1994 | Muramoto et al. |
| 5,380,810 | A | 1/1995 | Lai et al. |
| 5,382,400 | A | 1/1995 | Pike et al. |
| 5,384,373 | A | 1/1995 | McKinney et al. |
| 5,425,987 | A | 6/1995 | Shawver et al. |
| 5,472,775 | A | 12/1995 | Obijeski et al. |
| 5,645,542 | A | 7/1997 | Anjur et al. |
| 5,726,103 | A | 3/1998 | Stahl et al. |
| 5,736,465 | A | 4/1998 | Stahl et al. |
| 5,804,286 | A | 9/1998 | Quantrille et al. |
| 5,883,188 | A | 3/1999 | Hwang et al. |
| 5,910,224 | A | 6/1999 | Morman |
| 5,997,981 | A | 12/1999 | McCormack et al. |
| 5,997,989 | A | 12/1999 | Gessner et al. |
| 6,010,588 | A | 1/2000 | Stahl et al. |
| 6,060,636 | A | 5/2000 | Yahiaoui et al. |
| 6,117,803 | A | 9/2000 | Morman et al. |
| 6,140,442 | A | 10/2000 | Knight et al. |
| 6,176,952 | B1 | 1/2001 | Maugans et al. |
| 6,225,243 | B1 | 5/2001 | Austin |
| 6,323,389 | B1 | 11/2001 | Thomas et al. |
| 6,342,565 | B1 | 1/2002 | Cheng et al. |
| 6,417,122 | B1 | 7/2002 | Newkirk et al. |
| 6,420,285 | B1 | 7/2002 | Newkirk et al. |
| 6,461,133 | B1 | 10/2002 | Lake et al. |
| 6,500,540 | B1 | 12/2002 | Langohr et al. |
| 6,528,439 | B1 | 3/2003 | Stokes et al. |
| 6,541,403 | B1 | 4/2003 | Billarant et al. |
| 6,906,160 | B1 * | 6/2005 | Stevens et al. ..... 526/326 |
| 2001/0038912 | A1 | 11/2001 | Billarant et al. |

FOREIGN PATENT DOCUMENTS

| | | | |
|---|---|---|---|
| EP | 0748846 | A2 | 5/1992 |
| EP | 0622380 | A | 7/1998 |
| EP | 0875609 | A | 11/1998 |
| EP | 0924322 | A | 6/1999 |
| EP | 0805881 | B1 | 5/2002 |
| EP | 0672775 | B1 | 6/2002 |
| EP | 0859073 | B1 | 11/2003 |
| WO | WO-90/01521 | | 2/1990 |
| WO | WO-94/28219 | | 12/1994 |
| WO | WO-99/10580 | | 3/1999 |
| WO | WO 00/08243 | | 2/2000 |
| WO | WO 01/49908 | | 7/2001 |
| WO | WO-03/040442 | A1 | 5/2003 |
| WO | WO 04/067818 | | 8/2004 |

OTHER PUBLICATIONS

MicroPatent Abstract, JP 10266056 A, Oct. 6, 1998, Oji Paper Co Ltd.

Patent Abstracts of Japan, JP 09291454, Nov. 11, 1997, Kao Corp.

ASTM Designation: D 1238-01, "Standard Test Method for Melt Flow Rates of Thermoplastics by Extrusion Plastometer," Published Oct. 2001, pp. 1-12.

ASTM Designation: D 4703-03, "Standard Practive for Compression Molding Thermoplastic Materials into Test Specimens, Plaques, or Sheets," Published Sep. 2003, pp. 1-12.

ASTM Designation: D 792-00, "Standard Test Methods for Density and Specific Gravity (Relative Density) of Plastics by Displacement," Published Mar. 2001, pp. 1-6.

ASTM Designation: D 3108-01, "Standard Test Method for Coefficient of Friction, Yarn to Solid Material," Published Nov. 2001, pp. 1-6.

Bigg, D.M., "Effect of Copolymer Ratio on the Crystallinity and Properties of Polylactic Acid Copolymers", *Antec'96*, 1996, pp. 2028-2039.

Gallagher, P.K., "Differential Thermal Analysis and Differential Scanning Calorimetry," Chaper 1, Section IV, *Thermal Characterization of Polymeric Materials*, Seconfd Edition, vol. 1, Academic Press, 1981, pp. 73-102.

Wilchinsky, Z.W., "On Crystal Orientation in Polycrystalline Materials," *Journal of Applied Physics*, vol. 30, No. 1, Jan. 1959, p. 792.

* cited by examiner

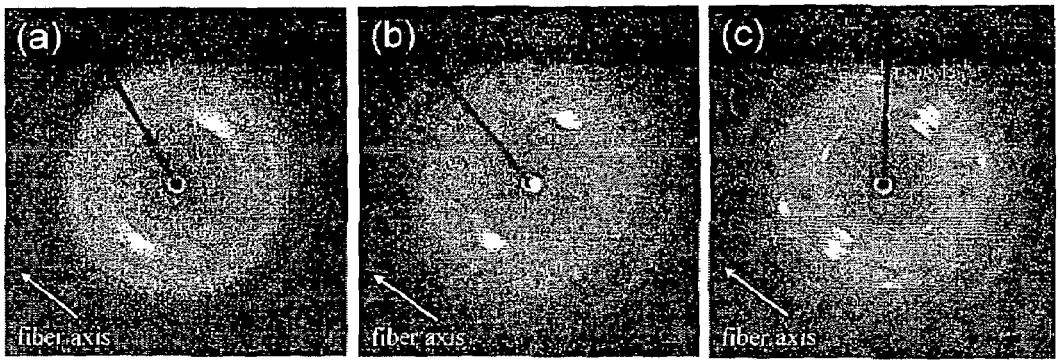
Figure 1: X-ray diffraction patterns of (a) C1/1; (b) C3/1; (c) Ex3/1 produced using the same spinning conditions (1000 m/min and 0.6 ghm)

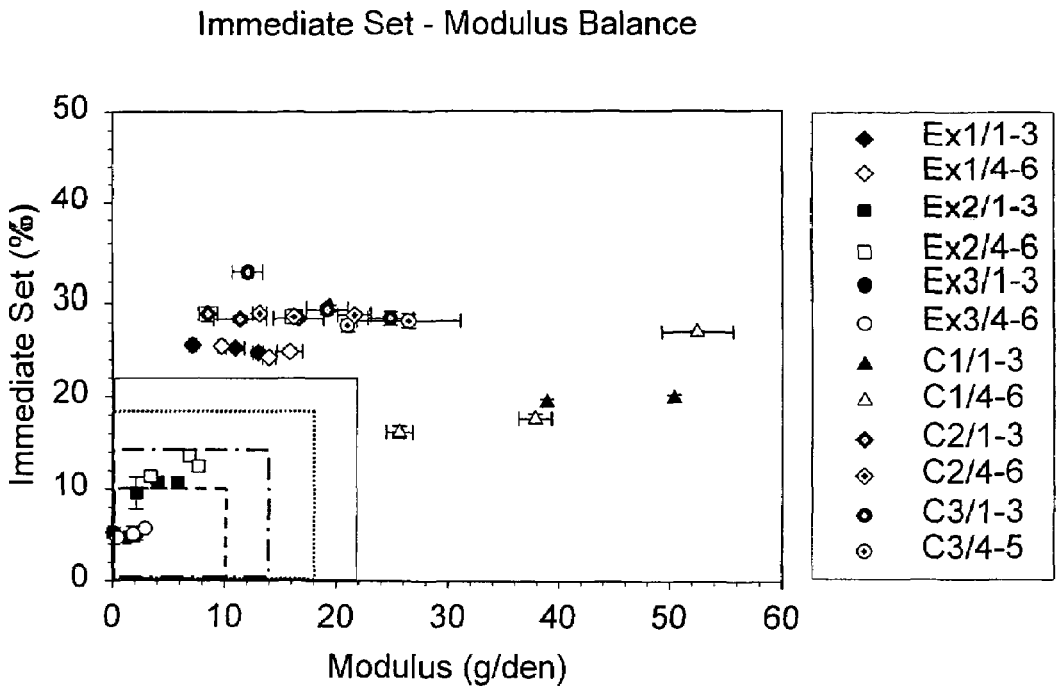
Figure 2: Comparing Immediate set and modulus behavior of inventive and comparative examples.

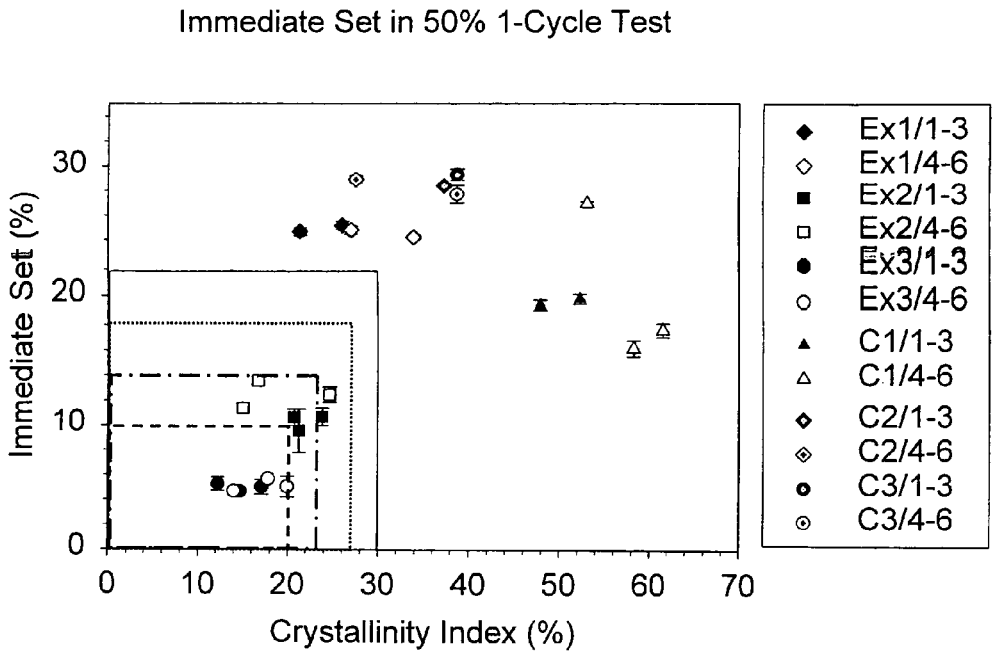
Figure 3: Immediate Set and Crystallinity Index

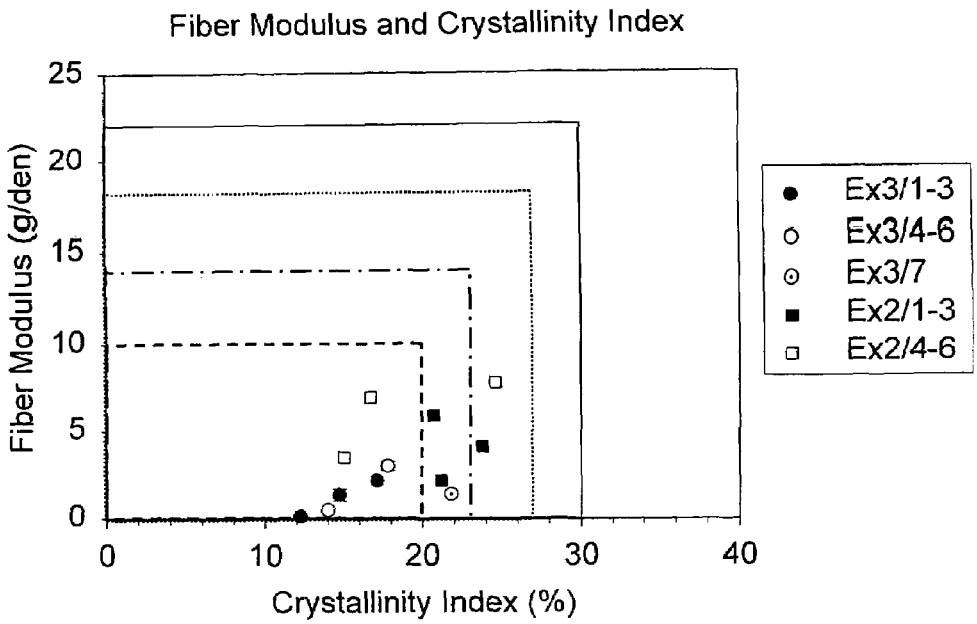
Figure 4: Fiber Modulus and Crystallinity Index.

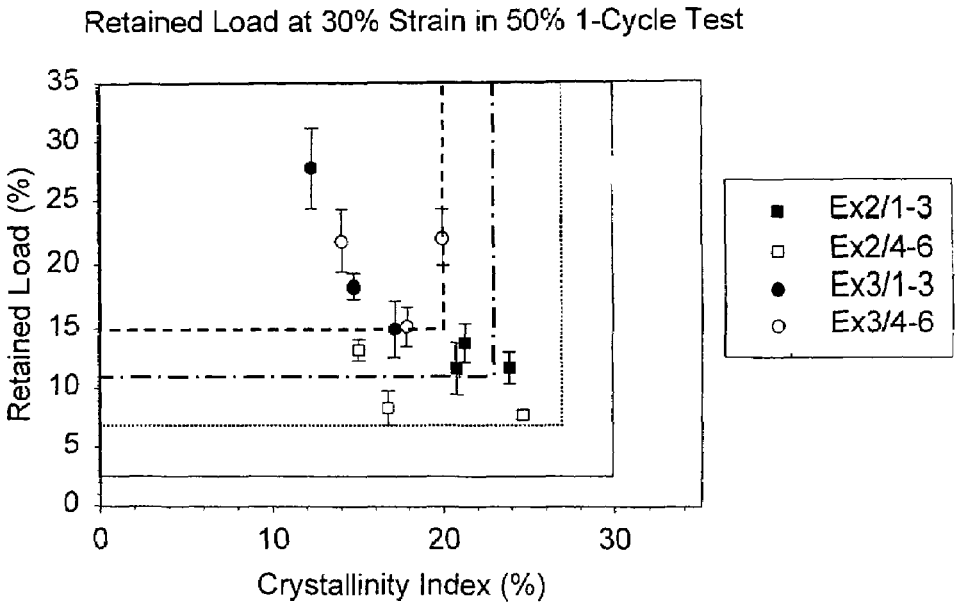
Figure 5: Retained load at 30% strain in 50% 1-Cycle Test and Crystallinity Index

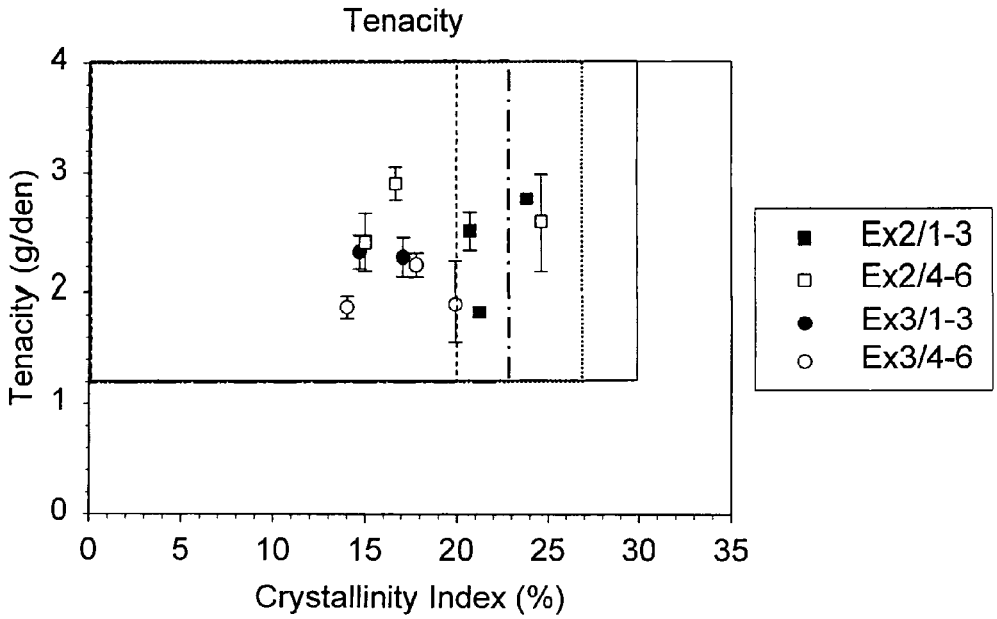
Figure 6: Tenacity and Crystallinity Index.

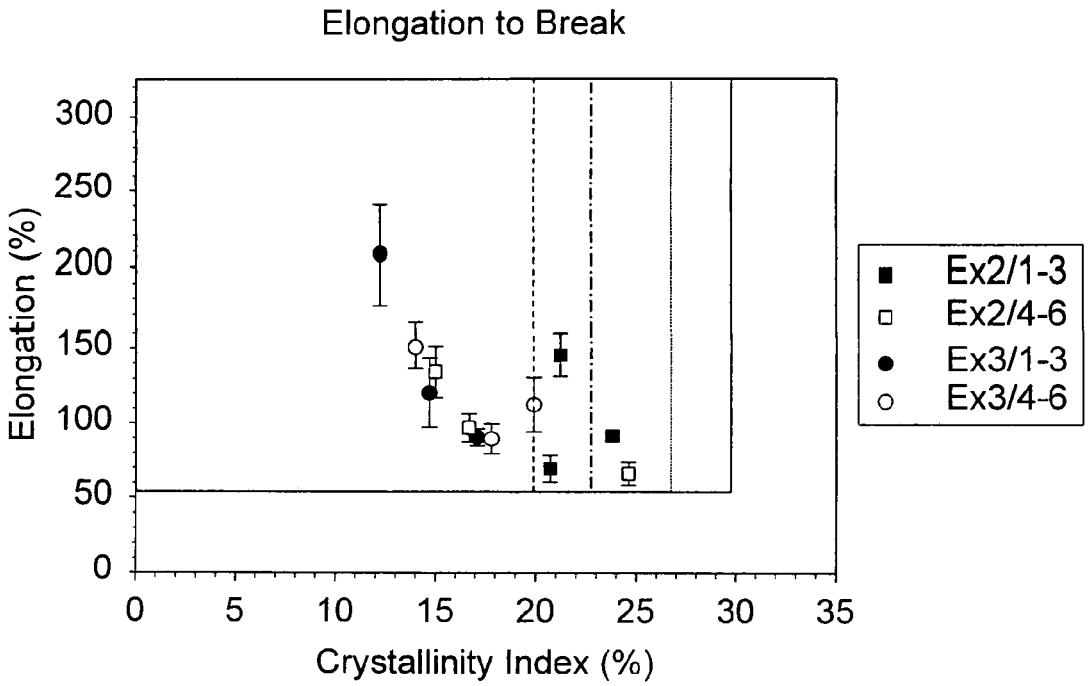
Figure 7: Elongation to Break and Crystallinity Index.

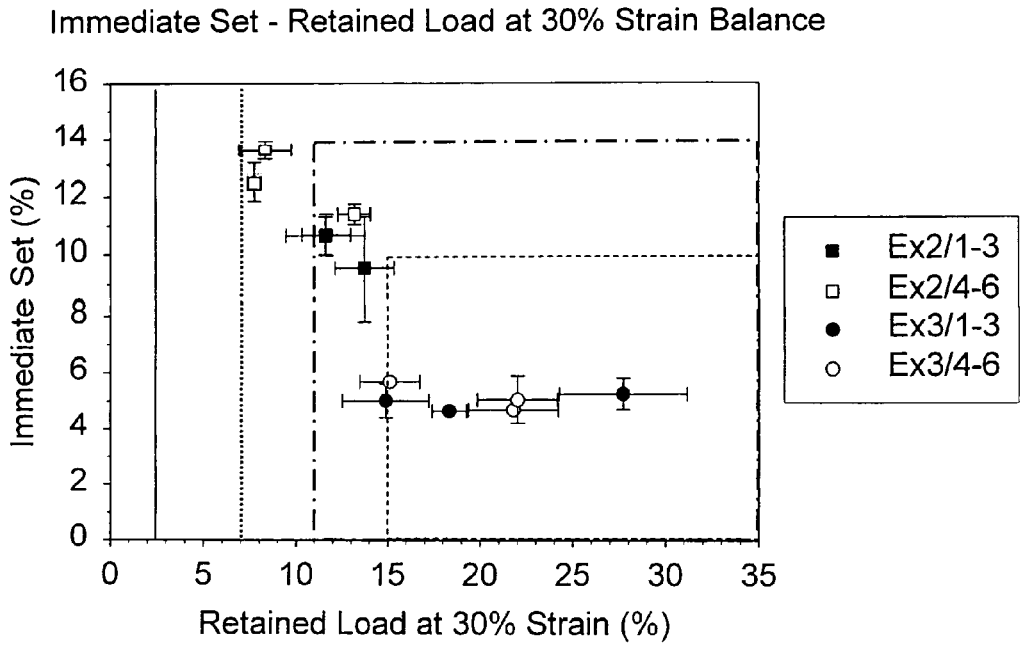
Figure 8: Immediate Set and Retained Load at 30% Strain in 50% 1-Cycle test.

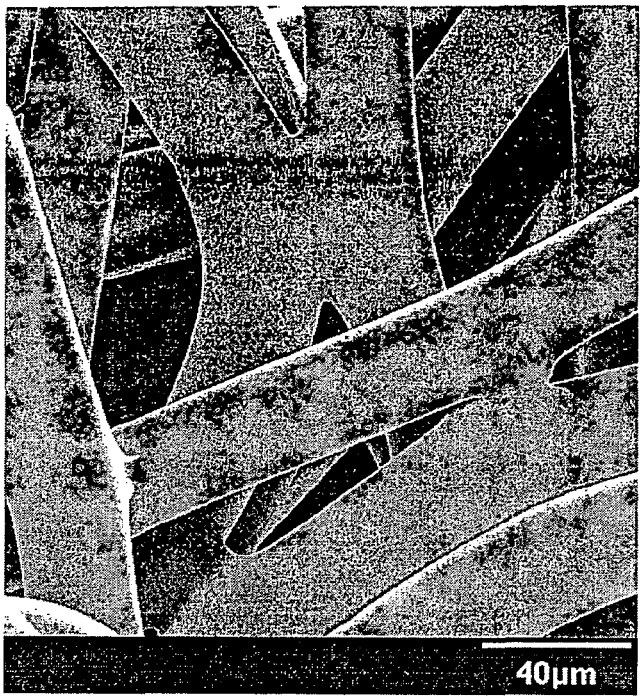
Figure 9: Nonwoven fabric of 12wt.% ethylene filaments and their self-bonding nature.

PROPYLENE-BASED COPOLYMERS, A METHOD OF MAKING THE FIBERS AND ARTICLES MADE FROM THE FIBERS

This application claims the benefit of U.S. Provisional Application No. 60/554,664, filed Mar. 19, 2004.

This application is being filed contemporaneously with a related application entitled "EXTENSIBLE AND ELASTIC CONJUGATE FIBERS AND WEBS HAVING A NON-TACKY FEEL" in the names of Joy F. Jordan et al., Ser. No. 11/068,098 which is incorporated herein by reference in its entirety.

FIELD OF THE INVENTION

This invention relates to fibers made from propylene-based copolymers. In one aspect, this invention relates to fibers made from propylene-based elastomers and plastomers while in another aspect, this invention relates to elastic or extensible fibers made from the same. In still other aspects, this invention relates to a method of making elastic fibers from the propylene-based elastomers and plastomers, and articles made from such fibers.

BACKGROUND OF THE INVENTION

Propylene-based polymers, particularly homo-polypropylene (hPP) are well known in the art, and have long been used in the manufacture of fibers. Fabrics made from hPP, particularly nonwoven fabrics, exhibit high modulus but poor elasticity. These fabrics are commonly incorporated into multicomponent articles, e.g., diapers, wound dressings, feminine hygiene products and the like. While polyethylene-based elastomers, and the fibers and fabrics made from these polymers, exhibit low modulus and good elasticity, they also exhibit a tenacity, stickiness and hand feel which are generally considered to be unacceptable for commercial applications.

Tenacity is important because the manufacture of multi-component articles typically involves multiple steps (e.g., rolling/unrolling, cutting, adhesion, etc.). Fibers with a high tensile strength are advantaged over fibers with a low tensile strength because the former will experience fewer line breaks (and thus greater productivity). Moreover, the end-use typically requires a level of tensile strength specific to the function of the component. Optimized fabrics have the minimum material consumption (basis weight) to achieve the minimum required tensile strength for the manufacture and end-use of the fiber, component (e.g., nonwoven fabric) and article.

Low modulus is one aspect of hand feel. Fabrics made from fibers with a low modulus will feel "softer", all else equal, than fabrics made from fibers with a high modulus. A fabric comprised of lower modulus fibers will also exhibit lower flexural rigidity which translates to better drapability and better fit. In contrast, a fabric made from a higher modulus fiber, e.g., hPP, will feel harsher (stiffer) and will drape less well (e.g., it will have a poorer fit). Fabrics made from polyethylene-based elastomers feels very tacky and clammy to the skin.

Fiber elasticity is important because it translates to better comfort-fit as the article made from the fiber will be more body conforming. Diapers with elastic components will have less sagging in general as body size and shape and movement vary. With improved fit, the general well being of the user is improved through improved comfort, reduced leakage and a closer resemblance of the article to cotton underwear.

Accordingly, interest remains high in a polymer that exhibits good elasticity and tenacity and low modulus when in the form of a fiber, and articles made from such fibers.

SUMMARY OF THE INVENTION

According to one embodiment of this invention, an elastic or extensible fiber comprises a propylene copolymer, the copolymer comprising at least about 50 weight percent of units derived from propylene and at least about 5 weight percent of units derived from a comonomer other than propylene, the copolymer characterized as having a crystallinity index as measured by X-ray diffraction of less than about 40%. Such copolymers with a crystallinity index between about 20% and about 40% form extensible fibers, while copolymers with crystallinity indices less than about 20% form elastic fibers. The comonomer is typically one or more of ethylene (a preferred comonomer), a $C_{4-20}$ $\alpha$-olefin, a $C_{4-20}$ diene, a styrenic compound, and the like.

In another embodiment of the invention, the fibers comprise propylene copolymers further characterized as having at least one of the following properties: (i) $^{13}C$ NMR peaks corresponding to a regio-error at about 14.6 and about 15.7 ppm, the peaks of about equal intensity, (ii) a DSC curve with a $T_{me}$ that remains essentially the same and a $T_{max}$ that decreases as the amount of comonomer, i.e., the units derived from ethylene and/or the unsaturated comonomer(s), in the copolymer is increased, and (iii) an X-ray diffraction pattern that reports more gamma-form crystals than a comparable copolymer prepared with a Ziegler-Natta (Z-N) catalyst. Typically the copolymers of this embodiment are characterized by at least two, preferably all three, of these properties. In other embodiments of this invention, these copolymers are characterized further as also having the following characteristic: (iv) a skewness index, $S_{ix}$, greater than about −1.20.

In another embodiment of the invention, the fiber is an extensible, high tenacity fiber comprising a propylene copolymer, the copolymer comprising at least about 50 weight percent of units derived from propylene and at least about 5 weight percent of units derived from a comonomer other than propylene, the fiber characterized as having a crystallinity index of less than 30%, a modulus of less than or equal to about 20 g/den, a retained load at 30% elongation as measured by a 50% 1-cycle test of more than 5%, and an immediate set as measured by a 50% 1-cycle test of less than or equal to about 30%. The fiber should be stretchable to at least 100% (i.e. 2×) of its original dimension.

In another embodiment of the invention, the fiber is an elastic fiber comprising a propylene copolymer, the copolymer comprising at least about 50 weight percent of units derived from propylene and at least about 5 weight percent of units derived from a comonomer other than propylene, the fiber characterized as having a crystallinity index of less than or equal to about 25%, a modulus of less than or equal to about 5 g/den, a tenacity of less than or equal to about 2.5 g/den, a retained load at 30% elongation as measured by a 50% 1-cycle test of greater than or equal to about 15%, and an immediate set as measured by a 50% 1-cycle test of less than or equal to about 15%. The fiber should be stretchable to at least 50% (i.e. 1.5×) of its original dimension.

In another embodiment, the invention is a method of forming a fiber, the fiber comprising a propylene copolymer, the copolymer comprising at least about 50 weight percent of units derived from propylene and at least about 5 weight percent of units derived from a comonomer other than propylene, the method comprising the steps of (i) forming a melt of the copolymer, (ii) extruding the melted copolymer through a die, and (iii) subjecting the extruded copolymer to a draw down greater than about 200. The fibers are oriented by subjecting the fiber to tensile elongation during a drawing operation. In one aspect of this embodiment, the tensile elongation is imparted in the quench zone of the drawing operation, i.e., between the spinneret and the godets.

Though not bound by the following theory, the orientation to produce these inventive fibers is thought to result in stress-induced crystallization. This crystallization, in turn, minimizes fiber blocking (i.e., sticking) and improves hand feel.

The fibers of this invention can be made from the propylene-based copolymers alone, or they can be made from blends of the propylene-based copolymers and one or more other polymers, and/or additives and/or nucleators. The fibers can take any form, e.g., monofilament, bicomponent, etc., and they can be used with or without post-formation treatment, e.g., annealing. Certain of the fibers of this invention are further characterized by substantial breakage before elongation to 300%, others by substantial breakage before elongation to 200%, and still others by substantial breakage before elongation to 100%.

The fibers of this invention are used to manufacture various articles of manufacture, e.g., fabrics (woven and nonwoven), which in turn can be incorporated into multi-component articles such as diapers, wound dressings, feminine hygiene products and the like.

BRIEF DESCRIPTION OF THE DRAWINGS

FIGS. 1A, 1B, 1C are photographs of X-ray film that evidence the smectic phases of polypropylene homopolymers (1A and 1B) and the alpha phase of a propylene-ethylene copolymer comprising 12 weight percent ethylene (1C).

FIG. 2 is a graph illustrating the immediate set and modulus behavior of propylene homo- and copolymers.

FIG. 3 is a graph illustrating the correlations of immediate set on crystallinity index of propylene homo- and copolymers.

FIG. 4 is a graph illustrating the correlation of fiber modulus on crystallinity index of the inventive propylene copolymer fibers FIG. 5 is a graph illustrating the correlation of retained load at 30% strain on crystallinity index of the inventive propylene copolymer fibers.

FIG. 6 is a graph illustrating the correlation of tenacity on crystallinity index of the inventive propylene copolymer fibers.

FIG. 7 is a graph illustrating the correlation of elongation and crystallinity index of propylene copolymer fibers.

FIG. 8 is a graph illustrating the correlation of immediate set and retained load at 30% strain of the inventive propylene copolymer fibers.

FIG. 9 is a micrograph of a nonwoven fabric showing the self-bonding capability of the inventive fibers made from propylene-ethylene copolymer containing 12 wt % ethylene.

DESCRIPTION OF THE PREFERRED EMBODIMENTS

"Polymer" means a macromolecular compound prepared by polymerizing monomers of the same or different type. "Polymer" includes homopolymers, copolymers, terpolymers, interpolymers, and so on. The term "interpolymer" means a polymer prepared by the polymerization of at least two types of monomers or comonomers. It includes, but is not limited to, copolymers (which usually refers to polymers prepared from two different types of monomers or comonomers, although it is often used interchangeably with "interpolymer" to refer to polymers made from three or more different types of monomers or comonomers), terpolymers (which usually refers to polymers prepared from three different types of monomers or comonomers), tetrapolymers (which usually refers to polymers prepared from four different types of monomers or comonomers), and the like. The terms "monomer" or "comonomer" are used interchangeably, and they refer to any compound with a polymerizable moiety which is added to a reactor in order to produce a polymer. In those instances in which a polymer is described as comprising one or more monomers, e.g., a polymer comprising propylene and ethylene, the polymer, of course, comprises units derived from the monomers, e.g., $—CH_2—CH_2—$, and not the monomer itself, e.g., $CH_2{=}CH_2$.

"P/E* copolymer" and similar terms mean a propylene/unsaturated comonomer (typically and preferably ethylene) copolymer characterized as having at least one of the following properties: (i) $^{13}C$ NMR peaks corresponding to a regio-error at about 14.6 and about 15.7 ppm, the peaks of about equal intensity, (ii) a DSC curve with a $T_{me}$ that remains essentially the same and a $T_{max}$ that decreases as the amount of comonomer, i.e., the units derived from ethylene and/or the unsaturated comonomer(s), in the copolymer is increased, and (iii) an X-ray diffraction pattern that reports more gamma-form crystals than a comparable copolymer prepared with a Ziegler-Natta (Z-N) catalyst. Typically, the copolymers of this embodiment are characterized by at least two, preferably all three, of these properties. In other embodiments of this invention, these copolymers are characterized further as also having the following characteristic: (iv) a skewness index, $S_{ix}$, greater than about −1.20.

With respect to the X-ray property of subparagraph (iii) above, a "comparable" copolymer is one having the same comonomer composition within 10%, and the same Mw within 10%. For example, if an inventive propylene/ethylene/1-hexene copolymer is 9 wt % ethylene and 1 wt % 1-hexene and has a Mw of 250,000, then a comparable polymer would have from 8.1–9.9 wt % ethylene, 0.9–1.1 wt % 1-hexene, and a Mw between 225,000 and 275,000, prepared with a Ziegler-Natta catalyst.

P/E* copolymers are a unique subset of P/E copolymers. P/E copolymers include all copolymers of propylene and an unsaturated comonomer, not just P/E* copolymers. P/E copolymers other than P/E* copolymers include metallocene-catalyzed copolymers, constrained geometry catalyst catalyzed copolymers and Z-N-catalyzed copolymers. For purposes of this invention, P/E copolymers comprise 50 weight percent or more propylene while EP (ethylene-propylene) copolymers comprise 51 weight percent or more ethylene. As here used, "comprise . . . propylene", "comprise . . . ethylene" and similar terms mean that the polymer comprises units derived from propylene, ethylene or the like as opposed to the compounds themselves.

"Metallocene-catalyzed polymer" or similar term means any polymer that is made in the presence of a metallocene catalyst. "Constrained geometry catalyst catalyzed polymer", "CGC-catalyzed polymer" or similar term means any polymer that is made in the presence of a constrained geometry catalyst. "Ziegler-Natta-catalyzed polymer", "Z-N-catalyzed polymer" or similar term means any polymer that is made in the presence of a Ziegler-Natta catalyst. "Metallocene" means a metal-containing compound having at least one substituted or unsubstituted cyclopentadienyl group bound to the metal. "Constrained geometry catalyst" or "CGC" as here used has the same meaning as this term is defined and described in U.S. Pat. Nos. 5,272,236 and 5,278,272.

"Random copolymer" means a copolymer in which the monomer is randomly distributed across the polymer chain. "Propylene homopolymer" and similar terms mean a polymer consisting solely or essentially all of units derived from propylene. "Polypropylene copolymer" and similar terms mean a polymer comprising units derived from propylene and ethylene and/or one or more unsaturated comonomers. The term "copolymer" includes terpolymers, tetrapolymers, etc.

The unsaturated comonomers used in the practice of this invention include, $C_{4-20}$ α-olefins, especially $C_{4-12}$ α-olefins such as 1-butene, 1-pentene, 1-hexene, 4-methyl-1-pentene, 1-heptene, 1-octene, 1-decene, 1-dodecene and the like; $C_{4-20}$ diolefins, preferably 1,3-butadiene, 1,3-pentadiene, norbornadiene, 5-ethylidene-2-norbornene (ENB) and dicyclopentadiene; $C_{8-40}$ vinyl aromatic compounds including sytrene, o-, m-, and p-methylstyrene, divinylbenzene, vinylbiphenyl, vinylnapthalene; and halogen-substituted $C_{8-40}$ vinyl aromatic compounds such as chlorostyrene and fluorostyrene. Ethylene and the $C_{4-12}$ α-olefins are the preferred comonomers used in the practice of this invention, and ethylene is an especially preferred comonomer.

The reactor grade propylene copolymers of this invention comprise at least about 50, preferably at least about 60 and more preferably at least about 70, wt % of units derived from propylene based on the weight of the copolymer. Sufficient units derived from propylene are present in the copolymer to ensure the benefits of the polypropylene (PP) stress-induced crystallization behavior during melt spinning, as well as the clear advantage of polypropylene's tendency to chain scission vs. cross-link during extrusion. Stress-induced crystallinity generated during draw facilitates spinning, reduces fiber breaks, and reduces roping.

It is intended that the term "reactor grade" is as defined in U.S. Pat. No. 6,010,588 and in general refers to a polyolefin resin whose molecular weight distribution (MWD) or polydispersity has not been substantially altered after polymerization.

Sufficient levels of comonomer other than propylene control the crystallization such that elastic performance is maintained. Although the remaining units of the propylene copolymer are derived from at least one comonomer such as ethylene, a $C_{4-20}$ α-olefin, a $C_{4-20}$ diene, a styrenic compound and the like, preferably the comonomer is at least one of ethylene and a $C_{4-12}$ α-olefin such as 1-hexene or 1-octene. Preferably, the remaining units of the copolymer are derived only from ethylene.

The amount of comonomer other than ethylene in the copolymer is a function of, at least in part, the comonomer and the desired crystallinity of the copolymer. The desired crystallinity index of the copolymer does not exceed about 40% and for elastic fibers, it does not exceed about 20%. If the comonomer is ethylene, then typically the comonomer-derived units comprise not in excess of about 16, preferably not in excess of about 15 and more preferably not in excess of about 12, wt % of the copolymer. The minimum amount of ethylene-derived units is typically at least about 5, preferable at least about 6 and more preferably at least about 8, wt % based upon the weight of the copolymer.

The propylene copolymers of this invention can be made by any process, and include copolymers made by Zeigler-Natta, CGC, metallocene, and nonmetallocene, metal-centered, heteroaryl ligand catalysis. These copolymers include random, block and graft copolymers although preferably the copolymers are of a random configuration. Exemplary propylene copolymers include Exxon-Mobil VISTAMAXX™, Mitsui TAFMER™ and propylene/ethylene plastomers or elastomers from The Dow Chemical Company.

The density of the copolymers of this invention is typically at least about 0.850, preferably at least about 0.860 and more preferably at least about 0.865, grams per cubic centimeter (g/cm$^3$). Typically the maximum density of the propylene copolymer is about 0.915, preferably the maximum is about 0.900 and more preferably the maximum is about 0.890, g/cm$^3$.

The weight average molecular weight (Mw) of the copolymers of this invention can vary widely, but typically it is between about 10,000 and 1,000,000 (with the understanding that the only limit on the minimum or the maximum $M_w$ is that set by practical considerations). For copolymers used in the manufacture of meltblown fibers, preferably the minimum Mw is about 20,000, more preferably about 25,000.

The polydispersity of the copolymers of this invention is typically between about 2 and about 4. "Narrow polydisperity", "narrow molecular weight distribution", "narrow MWD" and similar terms mean a ratio ($M_w/M_n$) of weight average molecular weight ($M_w$) to number average molecular weight ($M_n$) of less than about 3.5, preferably less than about 3.0, more preferably less than about 2.8, more preferably less than about 2.5, and most preferably less than about 2.3. Polymers for use in fiber applications typically have a narrow polydispersity. Blends comprising two or more of the copolymers of this invention, or blends comprising at least one copolymer of this invention and at least one other polymer, may have a polydispersity greater than 4 although for spinning considerations, the polydispersity of such blends is still preferably between about 2 and about 4.

In one preferred embodiment of this invention, the propylene copolymers are further characterized as having at least one of the following properties: (i) $^{13}C$ NMR peaks corresponding to a regio-error at about 14.6 and about 15.7 ppm, the peaks of about equal intensity, (ii) a DSC curve with a $T_{me}$ that remains essentially the same and a $T_{max}$ that decreases as the amount of comonomer, i.e., the units derived from ethylene and/or the unsaturated comonomer(s), in the copolymer is increased, and (iii) an X-ray diffraction pattern that reports more gamma-form crystals than a comparable copolymer prepared with a Ziegler-Natta (Z-N) catalyst. Typically the copolymers of this embodiment are characterized by at least two, preferably all three, of these properties. In other embodiments of this invention, these copolymers are characterized further as also having the following characteristic: (iv) a skewness index, $S_{ix}$, greater than about −1.20. Each of these properties and their respective measurements are described in detail in U.S. Ser. No. 10/139,786 filed May 5, 2002 (WO2003/040442) which is incorporated herein by reference.

The skewness index is calculated from data obtained from temperature-rising elution fractionation (TREF). The data is expressed as a normalized plot of weight fraction as a function of elution temperature. The separation mechanism is analogous to that of copolymers of ethylene, whereby the molar content of the crystallizable component (ethylene) is the primary factor that determines the elution temperature. In the case of copolymers of propylene, it is the molar content of isotactic propylene units that primarily determines the elution temperature.

The shape of the metallocene curve arises from the inherent, random incorporation of comonomer. A prominent characteristic of the shape of the curve is the tailing at lower elution temperature compared to the sharpness or steepness of the curve at the higher elution temperatures. A statistic that reflects this type of asymmetry is skewness. Equation 1 mathematically represents the skewness index, $S_{ix}$, as a measure of this asymmetry.

$$S_{ix} = \frac{\sqrt[3]{\sum w_i * (T_i - T_{\mathrm{Max}})^3}}{\sqrt{\sum w_i * (T_i - T_{\mathrm{Max}})^2}}. \qquad \text{Equation 1}$$

The value, $T_{max}$, is defined as the temperature of the largest weight fraction eluting between 50 and 90° C. in the TREF curve. $T_i$ and $w_i$ are the elution temperature and weight fraction respectively of an arbitrary, $i^{th}$ fraction in the TREF distribution. The distributions have been normalized (the sum of the $w_i$ equals 100%) with respect to the total area of the curve eluting above 30° C. Thus, the index reflects only the shape of the crystallized polymer. Any uncrystallized polymer (polymer still in solution at or below 30° C.) has been omitted from the calculation shown in Equation 1.

Differential scanning calorimetry (DSC) is a common technique that can be used to examine the melting and crystallization of semi-crystalline polymers. General principles of DSC measurements and applications of DSC to studying semi-crystalline polymers are described in standard texts (e.g., E. A. Turi, ed., *Thermal Characterization of Polymeric Materials*, Academic Press, 1981). Certain of the copolymers of this invention are characterized by a DSC curve with a $T_{me}$ that remains essentially the same and a $T_{max}$ that decreases as the amount of unsaturated comonomer in the copolymer is increased. $T_{me}$ means the temperature at which the melting ends. $T_{max}$ means the peak melting temperature.

The propylene copolymers of this invention typically have an MFR of at least about 0.01, preferably at least about 0.05, more preferably at least about 1 and most preferably at least about 10. The maximum MFR typically does not exceed about 2,000, preferably it does not exceed about 1000, more preferably it does not exceed about 500, further more preferably it does not exceed about 80 and most preferably it does not exceed about 50. MFR for copolymers of propylene and ethylene and/or one or more $C_4$–$C_{20}$ α-olefins is measured according to ASTM D-1238, condition L (2.16 kg, 230 degrees C.).

One preferred class of propylene copolymers of this invention are prepared by nonmetallocene, metal-centered, heteroaryl ligand catalysis. In certain embodiments, the metal is one or more of hafnium and zirconium.

More specifically, in certain embodiments of the catalyst, the use of a hafnium metal has been found to be preferred as compared to a zirconium metal for heteroaryl ligand catalysts. A broad range of ancillary ligand substituents may accommodate the enhanced catalytic performance. The catalysts in certain embodiments are compositions comprising the ligand and metal precursor, and, optionally, may additionally include an activator, combination of activators or activator package.

The catalysts used in the practice of this invention additionally include catalysts comprising ancillary ligand-hafnium complexes, ancillary ligand-zirconium complexes and optionally activators, which catalyze polymerization and copolymerization reactions, particularly with monomers that are olefins, diolefins or other unsaturated compounds. Zirconium complexes, hafnium complexes, compositions or compounds using the disclosed ligands are within the scope of the catalysts useful in the practice of this invention. The metal-ligand complexes may be in a neutral or charged state. The ligand to metal ratio may also vary, the exact ratio being dependent on the nature of the ligand and metal-ligand complex. The metal-ligand complex or complexes may take different forms, for example, they may be monomeric, dimeric or of an even higher order.

For example, suitable ligands useful in the practice of this invention may be broadly characterized by the following general formula:

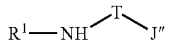

wherein $R^1$ is a ring having from 4–8 atoms in the ring generally selected from the group consisting of substituted cycloalkyl, substituted heterocycloalkyl, substituted aryl and substituted heteroaryl, such that $R^1$ may be characterized by the general formula:

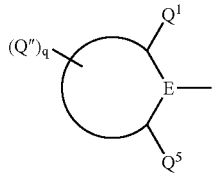

where $Q^1$ and $Q^5$ are substituents on the ring other than to atom E, with E being selected from the group consisting of carbon and nitrogen and with at least one of $Q^1$ or $Q^5$ being bulky (defined as having at least 2 atoms). $Q''_q$ represents additional possible substituents on the ring, with q being 1, 2, 3, 4 or 5 and Q" being selected from the group consisting of hydrogen, alkyl, substituted alkyl, cycloalkyl, substituted cycloalkyl, heteroalkyl, substituted heteroalkyl, heterocycloalkyl, substituted hetercycloalkyl, aryl, substituted aryl, heteroaryl, substituted heteroaryl, alkoxyl, aryloxyl, silyl, boryl, phosphino, amino, thio, seleno, halide, nitro, and combinations thereof. T is a bridging group selected group consisting of —$CR^2R^3$— and —$SiR^2R^3$— with $R^2$ and $R^3$ being independently selected from the group consisting of hydrogen, alkyl, substituted alkyl, cycloalkyl, substituted cycloalkyl, heteroalkyl, substituted heteroalkyl, heterocycloalkyl, substituted hetercycloalkyl, aryl, substituted aryl, heteroaryl, substituted heteroaryl, alkoxyl, aryloxyl, silyl, boryl, phosphino, amino, thio, seleno, halide, nitro, and combinations thereof. J" is generally selected from the group consisting of heteroaryl and substituted heteroaryl, with particular embodiments for particular reactions being described herein.

Also for example, in some embodiments, the ligands of the catalyst used to make the preferred propylene copolymers of this invention may be combined with a metal precursor compound that may be characterized by the general formula $Hf(L)_n$ where L is independently selected from the group consisting of halide (F, Cl, Br, I), alkyl, substituted alkyl, cycloalkyl, substituted cycloalkyl, heteroalkyl, substituted heteroalkyl, heterocycloalkyl, substituted heterocycloalkyl, aryl, substituted aryl, heteroaryl, substituted heteroaryl, alkoxy, aryloxy, hydroxy, boryl, silyl, amino, amine, hydrido, allyl, diene, seleno, phosphino, phosphine, carboxylates, thio, 1,3-dionates, oxalates, carbonates, nitrates, sulphates, and combinations thereof. n is 1, 2, 3, 4, 5, or 6.

Certain ligands complex to the metal resulting in complexes that are useful in the catalysis of the propylene copolymers of this invention. In one aspect, the 3,2 metal-ligand complexes that can be generally characterized by the following formula:

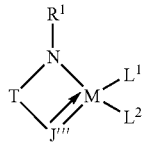

where

M is zirconium or hafnium;

$R^1$ and T are defined above;

J''' being selected from the group of substituted heteroaryls with 2 atoms bonded to the metal M, at least one of those atoms being a heteroatom, and with one atom of J''' is bonded to M via a dative bond, the other through a covalent bond; and $L^1$ and $L^2$ are independently selected from the group consisting of halide, alkyl, substituted alkyl, cycloalkyl, substituted cycloalkyl, heteroalkyl, substituted heteroalkyl, heterocycloalkyl, substituted heterocycloalkyl, aryl, substituted aryl, heteroaryl, substituted heteroaryl, alkoxy, aryloxy, hydroxy, boryl, silyl, amino, amine, hydrido, allyl, diene, seleno, phosphino, phosphine, carboxylates, thio, 1,3-dionates, oxalates, carbonates, nitrates, sulphates, and combinations of these radicals.

These catalysts and their use to make the preferred propylene copolymers of this invention are further described in U.S. Ser. No. 10/139,786 filed May 5, 2002.

The propylene copolymers used to make the fibers of this invention have many useful applications. Representative examples include mono- and multifilament fibers, mono- and bicomponent fibers, staple fibers, binder fibers, spunbond and meltblown fibers (using, e.g., systems as disclosed in U.S. Pat. Nos. 4,430,563, 4,663,220, 4,668,566 or 4,322,027), both woven and nonwoven fabrics, strapping, tape, continuous filament (e.g., for use in apparel, upholstery) and structures made from such fibers (including, e.g., blends of these fibers with other fibers such as PET or cotton). Staple and filament fibers can be melt spun into the final fiber diameter directly without additional drawing, or they can be melt spun into a higher diameter and subsequently hot or cold drawn to the desired diameter using conventional fiber drawing techniques. It should be understood that the term "spinning" or "spun" implies commercially available equipment and spinning rates.

Certain copolymers used in the practice of this invention exhibit excellent elasticity, particularly those with a crystallinity index of less than 20%. Whether or not pre-stretching is desirable will depend upon the application. For example, the elastomeric propylene copolymers of this invention can replace the thermoplastic triblock elastomers as the filament layer in the stretch bonded laminate process of U.S. Pat. No. 6,323,389. The filament layer would be stretched, preferably only once, prior to being sandwiched between the two spunbond layers. In an alternative example, the elastomeric polymers of this invention can replace the elastic layer in the necked bonded laminate process of U.S. Pat. No. 5,910,224. Some pre-stretching of the propylene polymer may be preferred.

The polymers of this invention, either alone or in combination with one or more other polymers (either polymers of the invention or polymers not of the invention) may be blended, if desired or necessary, with various additives such as antioxidants, ultraviolet absorbing agents, antistatic agents, nucleating agents, lubricants, flame retardants, anti-blocking agents, colorants, inorganic or organic fillers or the like. These additives are used in a conventional matter and in conventional amounts.

While the fibers of this invention can comprise a blend of the propylene copolymers used in the practice of this invention with one or more other polymers, and the polymer blend ratio can vary widely and to convenience, in one embodiment of this invention the fibers comprise at least about 98, preferably at least about 99 and more preferably essentially 100, weight percent of a propylene copolymer comprising at least about 50, preferably at least about 60 and more preferably at least about 70, weight percent of units derived from propylene and at least about 5 weight percent of units derived from a comonomer other than propylene (preferably ethylene or a $C_{4-12}$ α-olefin), the copolymer characterized as having a crystallinity index as measured by X-ray diffraction of less than about 40%. In another embodiment of the invention, the propylene copolymer comprises one or more P/E* copolymers. As noted earlier, fibers made from these polymers or polymer blends can take any one of a number of different forms and configurations.

Elastic fibers comprising polyolefins are known, e.g., U.S. Pat. Nos. 5,272,236, 5,278,272, 5,322,728, 5,380,810, 5,472,775, 5,645,542, 6,140,442 and 6,225,243. The polymers used in the practice of this invention can be used in essentially the same manner as known polyolefins for the making and using of elastic fibers. In this regard, the polymers used in the practice of this invention can include functional groups, such as a carbonyl, sulfide, silane radicals, etc., and can be crosslinked or uncrosslinked. If crosslinked, the polymers can be crosslinked using known techniques and materials with the understanding that not all crosslinking techniques and materials are effective on all polyolefins, e.g., while peroxide, azo and electromagnetic radiation (such as e-beam, UV, IR and visible light) techniques are all effective to at least a limited extent with polyethylenes, only some of these, e.g., e-beam, are effective with polypropylenes and then not necessarily to the same extent as with polyethylenes. The use of additives, promoters, etc., as noted earlier, can be employed as desired.

"Fiber" means a material in which the length to diameter ratio is typically greater than about 10. Fiber diameter can be measured and reported in a variety of fashions. Generally, fiber diameter is measured in denier per filament. Denier is a textile term which is defined as the grams of the fiber per 9000 meters of that fiber's length. Monofilament generally refers to an extruded strand having a denier per filament greater than 15, usually greater than 30. Fine denier fiber generally refers to fiber having a denier of about 15 or less. Microdenier (also known as microfiber) generally refers to fiber having a diameter smaller than 1 denier, or less than 12 microns for PP.

"Filament fiber" or "monofilament fiber" means a continuous strand of material of indefinite (i.e., not predetermined) length, as opposed to a "staple fiber" which is a discontinuous strand of material of definite length (i.e., a strand which has been cut or otherwise divided into segments of a predetermined length).

"Elastic" means that a fiber will have an immediate set of less than 15% as measured by the 50% 1-cycle test described below in the Measurement Methods. Elasticity can also be described by the "permanent set" of the fiber. Permanent set is the converse of elasticity. A fiber is stretched to a certain point and subsequently released to the original position before stretch, and then stretched again. The point at which the fiber begins to pull a load is designated as the percent permanent set. "Elastic materials" are also referred to in the art as "elastomers" and "elastomeric". Elastic material (sometimes referred to as an elastic article) includes the polymer itself as well as, but not limited to, the polymer in the form of a fiber, film, strip, tape, ribbon, sheet, coating, molding and the like. The preferred elastic material is fiber. The elastic material can be cured or uncured, radiated or unradiated, and/or crosslinked or uncrosslinked.

"Nonelastic material" means a material, e.g., a fiber, that is not elastic as defined above.

"Homofilament fiber", "monolithic fiber", "monocomponent fiber" and similar terms mean a fiber that has a single polymer region or domain, and that does not have any other distinct polymer regions (in contrast to bicomponent fibers).

"Bicomponent fiber" means a fiber that has two or more distinct polymer regions or domains. Bicomponent fibers are also known as conjugated or multicomponent fibers. The polymers are usually different from each other although two or more components may comprise the same polymer. The polymers are arranged in substantially distinct zones across the cross-section of the bicomponent fiber, and usually extend continuously along the length of the bicomponent fiber. The configuration of a bicomponent fiber can be, for example, a sheath/core arrangement (in which one polymer is surrounded by another), a side by side arrangement, a pie arrangement or an "islands-in-the sea" arrangement. Bicomponent fibers are further described in U.S. Pat. Nos. 6,225,243, 6,140,442, 5,382,400, 5,336,552 and 5,108,820.

"Meltblown fibers" are fibers formed by extruding a molten thermoplastic polymer composition through a plurality of fine, usually circular, die capillaries as molten threads or filaments into converging high velocity hot gas streams (e.g. air) which function to attenuate the threads or filaments to reduced diameters. The filaments or threads are carried by the high velocity hot gas streams and deposited on a collecting surface to form a web of randomly dispersed fibers with average diameters generally smaller than 10 microns.

"Meltspun fibers" are fibers formed by melting at least one polymer and then drawing the fiber in the melt to a diameter (or other cross-section shape) less than the diameter (or other cross-section shape) of the die.

"Spunbond fibers" are fibers formed by extruding a molten thermoplastic polymer composition as filaments through a plurality of fine, usually circular, die capillaries of a spinneret. The diameter of the extruded filaments is rapidly reduced, and then the filaments are deposited onto a collecting surface to form a web of randomly dispersed fibers with average diameters generally between about 7 and about 30 microns.

"Nonwoven" means a web or fabric having a structure of individual fibers or threads which are randomly interlaid, but not in an identifiable manner as is the case of a knitted fabric. The elastic fiber of the present invention can be employed to prepare nonwoven structures as well as composite structures of elastic nonwoven fabric in combination with nonelastic materials.

"Draw" means draw down, which is $V_{fiber}/V_{capillary}$ (approximately equal to $D^2_{capillary}/D^2_{fiber}$ if crystallinity changes from the melt to the fiber are ignored). $V_{fiber}$ means the velocity of the fiber at the winder, $V_{capillary}$ means the velocity of the fiber as it exits the spinneret. $D_{capillary}$ means the diameter of the cross-section of the capillary, and $D_{fiber}$ means the diameter of the cross-section of the fiber at the point of measurement. At constant denier per filament (dpf), draw down is fixed at a given capillary diameter regardless of production rate.

"Stick points" are usually measured by stringing up the fiber at fixed speeds (e.g., 1000, 2000, 3000 m/min), and then pressing a glass rod against the front of the fiber bundle at the bottom of the quench cabinet. The glass rod is raised until the fiber sticks to the rod. This is repeated 3 times at each speed and the stick points averaged. The stick point is taken as the distance down from the spinneret face in centimeters. Typically, for a given resin, the stick point decreases (crystallization rate is increased) as the spinning speed increases due to increased spinning stress and narrower fibers (improved heat transfer). Spinning stress can also be increased by increasing draw down, i.e., by using a larger hole die, as mass balance forces the fiber to come to the same final diameter (at constant take-up speed) regardless of the initial diameter (spinneret hole size). By increasing spinning stress, the fiber crystallizes faster, and the stick point moves up toward the die.

As used herein, for nonwovens, the term "extensible" includes materials that are stretchable to at least 150%. "Elastic" means that a web sample will have an immediate set of less than 15% as measured by the 50% 1-cycle test described above under Test Procedures. Elasticity can also be described by the "first cycle set" of the web. "Set" is as defined in the Test Procedures.

To quantify a fabric with good formation, the number of filament aggregates per 2 cm length is measured. Each filament aggregate is at least 10 times the fiber width in length. Care was taken to not include thermal and pressure bond points in the 2 cm length. Over a 2 cm length in random directions, the linear line count of filament aggregates was taken. Filament aggregates consist of multiple filaments in parallel orientation fused together. The filaments are fused for greater than 10 times the width of the fiber. Filament aggregates are separate from thermal or pressure bond points. For good web formation, the number of filament aggregates is lower than 30/2 cm, preferentially lower than 20/2cm.

The propylene copolymers used in the practice of this invention, particularly the P/E* copolymers, can be blended, as noted above, with other polymers to form the fibers of this invention. Suitable polymers for blending with these propylene copolymers are commercially available from a variety of suppliers and include, but are not limited to, other polyolefins such as an ethylene polymer (e.g., low density polyethylene (LDPE), ULDPE, medium density polyethylene (MDPE), LLDPE, HDPE, homogeneously branched linear ethylene polymer, substantially linear ethylene polymer, graft-modified ethylene polymer, ethylene-styrene interpolymers (ESI), ethylene vinyl acetate interpolymer, ethylene acrylic acid interpolymer, ethylene ethyl acetate interpolymer, ethylene methacrylic acid interpolymer, ethylene methacrylic acid ionomer, and the like), polycarbonate, polystyrene, conventional polypropylene (e.g., homopolymer polypropylene, polypropylene copolymer, random block polypropylene interpolymer and the like), thermoplastic polyurethane, polyamide, polylactic acid interpolymer, thermoplastic block polymer (e.g. styrene butadiene copolymer, styrene butadiene styrene triblock copolymer, styrene ethylene-butylene styrene triblock copolymer and the like), polyether block copolymer (e.g., PEBAX), copolyester polymer, polyester/polyether block polymers (e.g., HYTEL), ethylene carbon monoxide interpolymer (e.g., ethylene/carbon monoxide (ECO), copolymer, ethylene/acrylic acid/carbon monoxide (EAACO) terpolymer, ethylene/methacrylic acid/carbon monoxide (EMAACO) terpolymer, ethylene/vinyl acetate/carbon monoxide (EVACO) terpolymer and styrene/carbon monoxide (SCO)), polyethylene terephthalate (PET), chlorinated polyethylene, and the like and mixtures thereof. In other words, the propylene copolymer used in the practice of this invention can be blended with two or more polyolefins, or blended with one or more polyolefins and/or with one or more polymers other than a polyolefin. If the propylene copolymer used in the practice of this invention, or a blend of such copolymers, is blended with one or more polymers other than a propylene copolymer, then the polypropylene copolymer(s) preferably comprises at least about 50, more preferably at least about 70 and more preferably at least about 90, wt % of the total weight of the blend. As noted above, in one embodiment of the invention, the fiber comprises at least 98 wt % of a propylene copolymer, preferably a P/E* copolymer. For some applications, particularly when web uniformity is a concern, the fiber may comprise significant amounts (for example 10–40 wt % of the total weight of the blend) of a higher crystalline material such as homopolymer polypropylene. The amount of the various components in the blend can be optimized to balance extensibility/elasticity with other properties such as web uniformity.

In one embodiment, the propylene copolymer used in the practice of this invention is a blend of two or more propylene copolymers. Suitable propylene copolymers for use in the invention, including random propylene ethylene polymers, are available from a number of manufacturers, such as, for example, The Dow Chemical Company, Basell Polyolefins and Exxon Chemical Company. Suitable conventional and metallocene polypropylene polymers from Exxon are supplied under the designations ESCORENE and ACHIEVE. The propylene copolymer used in the practice of this invention can also be blended with homopolymer polypropylene (h-PP).

Suitable graft-modified polymers useful as blend polymers in the practice of this invention are well known in the art, and include the various ethylene polymers bearing a maleic anhydride and/or another carbonyl-containing, ethylenically unsaturated organic radical. Representative graft-modified polymers are described in U.S. Pat. No. 5,883,188, such as a homogeneously branched ethylene polymer graft-modified with maleic anhydride.

Suitable polylactic acid (PLA) polymers for use as blend polymers in the practice of this invention are well known in the literature (e.g., see D. M. Bigg et al., "Effect of Copolymer Ratio on the Crystallinity and Properties of Polylactic Acid Copolymers", ANTEC '96, pp. 2028–2039; WO 90/01521; EP 0 515203A and EP 0 748 846 A2). Suitable polylactic acid polymers are supplied commercially by Cargill Dow under the designation EcoPLA.

Suitable thermoplastic polyurethane (TPU) polymers for use as blend polymers in the practice of this invention are commercially available from BASF and from The Dow Chemical Company (the latter marketing them under the designation PELLETHANE).

Suitable polyolefin carbon monoxide interpolymers for use as blend polymers in the practice of this invention can be manufactured using well known high pressure free-radical polymerization methods. However, they may also be manufactured using traditional Ziegler-Natta catalysis, or with the use of so-called homogeneous catalyst systems such as those described and referenced above.

Suitable free-radical initiated high pressure carbonyl-containing ethylene polymers such as ethylene acrylic acid interpolymers for use as blend polymers in the practice of this invention can be manufactured by any technique known in the art including the methods taught by Thomson and Waples in U.S. Pat. No. 3,520,861, 4,988,781, 4, 599,392, and5,384,373.

Suitable ethylene vinyl acetate interpolymers for use as blend polymers in the practice of this invention are commercially available from various suppliers, including The Dow Chemical Company, Exxon Chemical Company and Du Pont Chemical Company.

Suitable ethylene/alkyl acrylate interpolymers for use as blend polymers in the practice of this invention are commercially available from various suppliers. Suitable ethylene/acrylic acid interpolymers for use as blend polymers in the practice of this invention are commercially available from The Dow Chemical Company under the designation PRIMACOR. Suitable ethylene/methacrylic acid interpolymers for use as blend polymers in the practice of this invention are commercially available from DuPont Chemical Company under the designation NUCREL.

Chlorinated polyethylene (CPE), especially chlorinated substantially linear ethylene polymers, for use as blend polymers in the practice of this invention can be prepared by chlorinating polyethylene in accordance with well known techniques. Preferably, chlorinated polyethylene comprises equal to or greater than 30 weight percent chlorine. Suitable chlorinated polyethylenes for use as blend polymers in the practice of this invention are commercially supplied by The Dow Chemical Company under the designation TYRIN.

Bicomponent fibers can also be made from the propylene P/E* copolymers of this invention. Such bicomponent fibers have the polypropylene polymer of the present invention in at least one portion of the fiber. For example, in a sheath/core bicomponent fiber (i.e., one in which the sheath surrounds the core), the polypropylene can be in either the sheath or the core. Different polypropylene polymers of this invention can also be used independently as the sheath and the core in the same fiber, preferably where both components are elastic and especially where the sheath component has a higher melting point than the core component. Other types of bicomponent fibers are within the scope of the invention as well, and include such structures as side-by-side conjugated fibers (e.g., fibers having separate regions of polymers, wherein the polyolefin of the present invention comprises at least one region of the fiber).

The shape of the fiber is not limited. For example, typical fiber has a circular cross-sectional shape, but sometimes fibers have different shapes, such as a trilobal shape, or a flat (i.e., "ribbon" like) shape. The fiber embodiments of this invention are not limited by the shape of the fiber.

The fibers of this invention can be made using any conventional technique including melt blown, melt spun and spun bond. For melt spun fibers, the melt temperature, throughput, fiber speed and drawdown can vary widely. Typical melt temperatures range between 190 and 245C with the higher temperatures supporting higher throughputs and fiber speeds, particularly for melts of polymers with a relatively high MFR, e.g., 25 or greater. Throughput, measured in grams/hole/minute (ghm), typically ranges between 0.1 and 1.0, preferably between 0.2 and 0.7, ghm. Fiber speed typically ranges from less than 1000 to more than 3000, but preferably between 1000 and 3000 meters per minute (m/min). Drawdown varies from less than 500 to more than 2500. Generally, greater draw down results in a more inelastic fiber.

The fibers of this invention can be used with other fibers such as those made from PET, nylon, cotton, Kevlar™, etc. to make elastic and nonelastic fabrics.

Fabrics made from the elastic fibers of this invention include woven, nonwoven and knit fabrics. Nonwoven fabrics can be made various by methods, e.g., spunlaced (or hydrodynamically entangled) fabrics as disclosed in U.S. Pat. Nos. 3,485,706 and 4,939,016, carding and thermally bonding staple fibers; spunbonding continuous fibers in one continuous operation; or by melt blowing fibers into fabric and subsequently calendaring or thermally bonding the resultant web. These various nonwoven fabric manufacturing techniques are well known to those skilled in the art and the disclosure is not limited to any particular method. Other structures made from such fibers are also included within the scope of the invention, including e.g., blends of these novel fibers with other fibers (e.g., poly(ethylene terephthalate) or cotton).

Fabricated or multicomponent articles that can be made using the fibers and fabrics of this invention include composite articles (e.g., diapers) that have elastic portions. For example, elastic portions are typically constructed into diaper waist band portions to prevent the diaper from falling and leg band portions to prevent leakage (as shown in U.S. Pat. No. 4,381,781). Often, the elastic portions promote better form fitting and/or fastening systems for a good combination of comfort and reliability. The inventive fibers and fabrics of this invention can also produce structures which combine elasticity with breathability. For example, the inventive fibers, fabrics and/or films may be incorporated into the structures disclosed in U.S. Pat. No. 6,176,952.

Both the propylene copolymers and fibers made from the copolymers can be subjected to post reaction/formation treatments, e.g. crosslinking, annealing and the like. The benefits and techniques of annealing are described in U.S. Pat. No. 6,342,565. These post treatments are applied in their conventional manner.

The following examples are given to illustrate various embodiments of the invention. They do not intend to limit the invention as otherwise described and claimed herein. All numerical values are approximate. When a numerical range is given, it should be understood that embodiments outside the range are still within the scope of the invention unless otherwise indicated. In the following examples, various polymers were characterized by a number of methods. Performance data of these polymers were also obtained. Most of the methods or tests were performed in accordance with an ASTM standard, if applicable, or known procedures. All parts and percentages are by weight unless otherwise indicated.

SPECIFIC EMBODIMENTS

The effect of spinning conditions was examined for polymers with 25–38 MFR. Elongational stresses achieved by controlling throughput and take-off rate determined the amount of stress-induced crystallinity in the fiber and hence the resulting mechanical properties. Higher elongational stresses achieved at a draw down greater than 1000 resulted in higher crystallinity and hence more rigid fibers. More elasticity was preserved at lower crystallinity or draw down less than 1000. For more elastic fiber, very low crystallinity or draw down less than 500 was preferred. To verify that elasticity was maintained, the tensile hysteresis behavior was measured.

Measurement Methods

Density Method:

Coupon samples (1 inch×1 inch×0.125 inch) were compression molded at 190° C. according to ASTM D4703-00 and cooled using procedure B. Once the sample cooled to 40–50° C., it was removed. Once the sample reached 23° C., its dry weight and weight in isopropanol was measured using an Ohaus AP210 balance (Ohaus Corporation, Pine Brook N.J.). Density was calculated as prescribed by ASTM D792 procedure B.

DSC Method:

Differential scanning calorimetry (DSC) is a common technique that can be used to examine the melting and crystallization of semi-crystalline polymers. General principles of DSC measurements and applications of DSC to studying semi-crystalline polymers are described in standard texts (e.g., E. A. Turi, ed., *Thermal Characterization of Polymeric Materials*, Academic Press, 1981). Certain of the copolymers used in the practice of this invention are characterized by a DSC curve with a $T_{me}$ that remains essentially the same and a $T_{max}$ that decreases as the amount of unsaturated comonomer in the copolymer is increased. $T_{me}$ means the temperature at which the melting ends. $T_{max}$ means the peak melting temperature.

Differential Scanning Calorimetry (DSC) analysis is determined using a model Q1000 DSC from TA Instruments, Inc. Calibration of the DSC is done as follows. First, a baseline is obtained by running the DSC from −90° C. to 290° C. without any sample in the aluminum DSC pan. Then 7 milligrams of a fresh indium sample is analyzed by heating the sample to 180° C., cooling the sample to 140° C. at a cooling rate of 10C/min followed by keeping the sample isothermally at 140° C. for 1 minute, followed by heating the sample from 140° C. to 180° C. at a heating rate of 10° C./min. The heat of fusion and the onset of melting of the indium sample are determined and checked to be within 0.5° C. from 156.6° C. for the onset of melting and within 0.5 J/g from 28.71 J/g for the heat of fusion. Then deionized water is analyzed by cooling a small drop of fresh sample in the DSC pan from 25° C. to −30° C. at a cooling rate of 10° C./min. The sample is kept isothermally at −30° C. for 2 minutes and heated to 30° C. at a heating rate of 10° C./min. The onset of melting is determined and checked to be within 0.5° C. from 0° C.

The polypropylene samples are pressed into a thin film at a temperature of 190° C. About 5 to 8 mg of sample is weighed out and placed in the DSC pan. The lid is crimped on the pan to ensure a closed atmosphere. The sample pan is placed in the DSC cell and the heated at a high rate of about 100° C./min to a temperature of about 60° C. above the melt temperature. The sample is kept at this temperature for about 3 minutes. Then the sample is cooled at a rate of 10° C./min to −40° C., and kept isothermally at that temperature for 3 minutes. Consequently the sample is heated at a rate of 10° C./min until complete melting. The resulting enthalpy curves are analyzed for peak melt temperature, onset and peak crystallization temperatures, heat of fusion and heat of crystallization, $T_{me}$, and any other DSC analyses of interest.

X-Ray Experimental:

The samples were conveniently analyzed in a transmission mode using a GADDS system from Bruker-AXS, with a multi-wire two-dimensional HiStar detector. Samples were aligned with a laser pointer and a video-microscope. Data were collected using copper Kα radiation (at a wavelength of 1.54 angstroms) with a sample-to-detector (SDD) distance of 6 cm. The X-ray beam was collimated to 0.3 mm. For the 2D area detector in transmission mode, the radial distance from the center, r, is equal to SDD×(tan 2θ), where 2θ is equal to the angle between the incident x-ray beam and the diffracted beam. For Cu Kα radiation and an SDD of 6 cm, the range of 2θ actually measured was about 0° to 35°. The azimuthal angle, ϕ, ranged from 0°–360°

Data Analysis:

Conventionally, the scattering area (or intensity) from amorphous segments, which lies underneath the diffraction area from the crystal phase, is determined by profile fitting of a diffraction profile using an appropriate software package (e.g., the Jade software, from Materials Data, Inc, that was used here). Then, the absolute crystallinity, $X_{C\text{-}Abs}$, is calculated based on the ratio of these two area values as given below:

$$X_{C-\mathrm{Abs}} = \left(1 - \frac{I_{Am}}{I_{Total}}\right) \qquad \text{Equation 2}$$

where $I_{Am}$ is the integrated intensity, after background subtraction, for the amorphous scattering, and $I_{Total}$, is the total intensity measured and incorporates the scattering and diffraction of both polymer phases (again, after background subtraction). The method of determining $I_{Total}$ is detailed more later.

However, such an analysis is most accurate only in the absence of significant preferred orientation (both of the crystalline and amorphous phases) and for samples with relatively high crystallinity, where the peaks are strong and well defined. In the case of the highly oriented, low crystallinity fibers of this study, conventional profile fitting, using the data for the entire 360° azimuthal range, did not yield a reproducible and reliable estimate of the shape of the amorphous scattering curve, $I_{Am}$, and a different method for quantifying this value had to be devised, as will be discussed following the discussion of $I_{Total}$ determination below.

For all samples in this study, whether low or high in crystallinity or orientation, the total integrated intensity due to both crystal phase diffraction and amorphous phase scattering, or $I_{Total}$, was obtained as follows. First, the 2D screen was divided into small bands (concentric circles) of thickness Δr. At each r+Δr distance from the center of the detector out to the edges of the screen, the intensity was averaged over 360°(i.e., from ϕ=0°to 360°) to give $I_{AVG}(r)$, which was then integrated from r=0 to $r=r_{max}$ (or 2θ from 0° to 35°) to give $I_{Total}$.

The amorphous scattering, on the other hand, was not determined from such a total angular profile. Instead, the intensities of amorphous scattering were determined in only two extreme, or particular, directions of ϕ (i.e. using only two particular azimuthal angles) along the fiber direction (ϕ=0°), and 2) along a "near equatorial" direction approximately perpendicular to the fiber direction (12 degrees off the equatorial direction, or ϕ=78°). Along these two directions, the intensity from 0° to 35° 2θ is essentially all due to amorphous scattering, as crystal peak diffraction in these two directions is very weak or absent, and a reliable determination of the true shape of the amorphous peak is obtained.

The average of amorphous scattering area, $I_{Am}$, for the entire 0–360 degrees of ϕwas then estimated from $I_{Am}(\phi=0°)$ and $I_{Am}(\phi=78°)$ as:

$$I''_{Am} = \tfrac{1}{2} * [I_{Am}(\phi=0°) + I_{Am}(\phi=78°)] \qquad \text{Equation 3}$$

where, again, $I_{am}(\phi=0°)$ is the integrated intensity of amorphous scattering along the fiber axis from 0° to 35°2θ, and $I_{am}(\phi=78°)$ is the same obtained at an angle 12° off the equatorial (perpendicular) axis. The crystallinity index, Xc, is then determined similarly to Equation 2 as follows:

$$X_C = \left(1 - \frac{I''_{Am}}{I_{Total}}\right) \times 100 \qquad \text{Equation 4}$$

where $X_{C\text{-}Abs}$ has been changed to $X_C$ to indicate that $X_C$ is an index of the amount of crystallinity in the sample, not an absolute crystallinity level, due to the presence of preferred crystal phase orientation. However, by using Equation 4, the crystallinity index calculated was found to be reliable and reproducible for samples across a broad range of crystallinities, from a few percent to about 40%.

The Amorphous Orientation was obtained by the ratio of amorphous scattering intensities in the fiber direction to that in the near equatorial direction, or:

$$\text{Amorphous Orientation} = I_{Am}(\phi=0°)/I_{Am}(\phi=78°) \qquad \text{Equation 5}$$

noting that, for oriented fibers, $I_{Am}(\phi=78°)$ is greater than $I_{Am}(\phi=0°)$. Based on this definition, a value of 0 represents perfect amorphous orientation, and 1 represents random orientation. These data were also found to be quite reproducible and reliable across a broad orientation and crystallinity range.

For the crystal orientation, a conventional Hermans' Orientation function, $f_c$, was determined using Wilchinsky's method (*J. Appl. Physics*, 30, 792 (1959)). The calculated $f_c$ represents the degree of crystal orientation along the fiber direction. A value of 1 represents perfect orientation, 0 represent random orientation, and −0.5 represents perfectly perpendicular orientation.

Tensile Test:

A tow of 144 filaments was loaded between two pneumatically activated line-contact grips separated by 2 inches. This is taken to be the gauge length. The flat grip facing is coated with rubber. Pressure is adjusted to prevent slippage (usually 50–100 psi). The crosshead is increased at 10 inches per minute until the specimen breaks. Strain is calculated by dividing the crosshead displacement by 2 inches and multiplying by 100. Reduced load (g/denier) equals [load (grams force)/number of filaments/denier per filament]. Elongation was defined according to equation 6:

$$\text{Elongation}(\%) = \frac{L_{break} - L_o}{L_o} \times 100\% \qquad \text{Equation 6}$$

such that $L_o$ is the initial length of two inches, and $L_{break}$ is the length at break. Tenacity is defined according to the equation 7:

$$\text{Tenacity}(g/den) = \frac{F_{break}(g)}{d \times f} \qquad \text{Equation 7}$$

such that $F_{break}$ is the force at break measured in grams force, d is denier per filament, and f is the number of filaments in the tow that is being tested.

50% 1-Cycle Test:

The sample was loaded and the grip spacing was set up as done in the tensile test. The crosshead speed was set at 10 inches per minute. The crosshead was raised until a strain of 50% was applied, and then the crosshead was returned at the same crosshead speed to 0% strain. After returning to 0% strain, the crosshead was extended at 10 inches per minute. The onset of load was taken as the immediate set. Reduced load was measured during the first extension and first retraction of the sample at 30% strain. Retained load was calculated as the reduced load at 30% strain during retraction divided by the reduced load at 30% strain during extension multiplied by 100.

Nonwoven Measurements:

Specimens for nonwoven measurements were obtained by cutting 3 inch wide by 8 inch strips from the web in the machine (MD) and cross direction (CD). Basis weight, in $g/m^2$, was determined for each sample by dividing the weight, measured with an analytical balance, divided by the area. Samples were then loaded into a Sintech fitted with pneumatically activated line-contact grips with an initial separation of 3 inches and pulled to break at 12 inches/min. Peak load and peak strain were recorded for each tensile measurement.

Elasticity was measured using a 1-cycle hysteresis test to 80% strain. In this test, samples were loaded into a Sintech fitted with pneumatically activated line-contact grips with an initial separation of 4 inches. Then the sample was stretched to 80% at 500 mm/min, and returned to 0% strain at the same speed. The strain at 10 g load upon retraction was taken as the % set. The hysteresis loss is defined as the energy difference between the strain and retraction cycle. The load down was the retractive force at 50% strain. In all cases, the samples were measured green or unaged.

Filament Aggregates:

To quantify a fabric with good formation, the following method was employed. A Nikon SNZ-10 binocular microscope was used at 10× magnification with incident light to count the number of filament aggregates over a given length. Only filaments aggregates that intersected the 2 cm line were counted. Each filament aggregate is at least 10 times the fiber width in length. Care was taken to not include thermal and pressure bond points in the 2 cm length. Over a 2 cm length in random directions, the linear line count of filament aggregates was taken. 'Filament aggregates' consist of multiple filaments in parallel orientation fused together. The filaments are considered fused, if the length of fusion persists for greater than 10 times the width of the fiber. Filament aggregates are separate from thermal or pressure bond points.

Scanning Electron Microscopy:

Samples for scanning electron microscopy were mounted on aluminum sample stages with carbon black filled tape and copper tape. The mounted samples were then coated with 100–200 Å of gold using an SPI-Module Sputter Coater (Model Number 11430) from Structure Probe Incorporated (West Chester, Mass.) fitted with an argon gas supply and a vacuum pump.

The gold coated samples were then examined in a Hitachi S4100 scanning electron microscope equipped with a field effect gun and supplied by Hitachi America, Ltd (Shaumberg, Ill.). Samples were examined using secondary electron imaging mode were measured using an acceleration voltage of 3–5 kV and collected using a digital image capturing system.

Experimental Data

The different resins used are presented in Table 1. In that Table "X-Ray Crystallinity Index" refers to the crystallinity index of a rapidly quenched compression molded film sample and is therefore not directly comparable with crystallinity indices reported for fiber samples in the subsequent tables.

Propylene-ethylene copolymers comprising about 9–16 wt. % ethylene were used in the following examples. For comparison, an ethylene-octene copolymer and a polypropylene homopolymer were also used. The melt flow ratio (MFR) of each polymer was 20–40 (or about a 10–20 melt index (MI) equivalent).

TABLE 1

RESINS

| | Polymer Type | Description | MI or MFR | Density ($g/cm^3$) | DSC Heat of Melting (J/g) | Melting Points (° C.) | X-Ray Crystallinity Index (%) |
|---|---|---|---|---|---|---|---|
| Ex1 | propylene-ethylene | 5 wt % ethylene | 25 MFR | 0.8887 | 71 | 115 | 52 |
| Ex2 | propylene-ethylene | 9 wt % ethylene | 25 MFR | 0.876 | 54 | 104,134 | 31 |
| Ex3 | propylene-ethylene | 12 wt % ethylene | 25 MFR | 0.867 | 34 | 51,124 | 17 |
| Ex4 | propylene-ethylene | 15 wt % ethylene | 25 MFR | 0.860 | 18 | 124 | — |

TABLE 1-continued

RESINS

| | Polymer Type | Description | MI or MFR | Density (g/cm$^3$) | DSC Heat of Melting (J/g) | Melting Points (° C.) | X-Ray Crystallinity Index (%) |
|---|---|---|---|---|---|---|---|
| C1 | homopolymer PP | — | 38 MFR | 0.900 | 110 | 162 | — |
| C2 | random PP copolymer | 3 wt. % ethylene | 35 MFR | 0.90 | 89 | 143 | — |
| C3 | metallocene PP | — | 24 MFR | 0.90 | 103 | 149 | — |
| C4 | ethylene-octene | 38–40 wt % octene | 10 MI | 0.870 | 50 | 51,62 | — |

In this and the following tables, Ex1–Ex4 are the inventive examples and C1–C4 are the comparative examples.

Fibers were spun under a variety of conditions. The main variables were throughput (grams/hole/minute or ghm), which was controlled by pump speed, extruder design, and die parameters. The spinneret had 144 holes, each of which had a diameter of 0.65 mm and a length/diameter ratio (L/D) of 3.85. The quench air temperature was 12° C. and was distributed over the three zones. The air velocities in each of the zones were measured as 0.20, 0.28 and 0.44 m/s using a hot-wire anemometer. Melt temperature was varied from 190 to 245° C. Draw down was controlled by a combination of spinning speed and pump rate.

Six spinning runs were conducted using the propylene copolymer Ex1. The melt temperature of each run was 220° C., the throughput was 0.6 ghm for Runs Ex1/1–3 and 0.3 ghm for Runs Ex1/4–6, and the spinning speed (meters/minute or m/min) was 1000 m/min for Runs Ex1/1 and Ex1/4, 2000 m/min for Runs Ex1/2 and Ex1/5, and 3000 m/min for Runs Ex1/3 and Ex1/6. The data are presented in Table 2.

TABLE 2

SPINNINING CONDITIONS AND X-RAY CHARACTERIZATION OF EX1 FIBERS

| Run No. | Draw Down | Denier/ Filament | Crystal Type | Crystallinity Index, Xc (%) | Amorphous Orientation | Crystal Orientation, fc |
|---|---|---|---|---|---|---|
| Ex1/1 | 421 | 5.4 | smectic & α | — | — | — |
| Ex1/2 | 841 | 2.7 | α | 26.0 | 0.62 | 0.887 |
| Ex1/3 | 1261 | 1.8 | α | 21.3 | 0.63 | 0.893 |
| Ex1/4 | 841 | 2.7 | α | — | — | — |
| Ex1/5 | 1681 | 1.35 | α | 33.9 | 0.72 | 0.914 |
| Ex1/6 | 2522 | 0.9 | α | 27.0 | 0.70 | 0.911 |

Six spinning runs were conducted using the propylene copolymer Ex2. The melt temperature of each run was 220° C., the throughput was 0.6 ghm for Runs Ex2/1–3 and 0.3 ghm for Runs Ex2/4–6, and the spinning speed (meters/minute or m/min) was 1000 m/min for Runs Ex2/1 and Ex2/4, 2000 m/min for Runs 2/2 and 2/5, and 3000 m/min for Runs Ex2/3 and Ex2/6. The data are presented in Table 3.

TABLE 3

SPINNING CONDITIONS AND X-RAY CHARACTERIZATION OF EX2 FIBERS

| Run No. | Draw Down | Denier/ Filament | Crystal Type | Crystallinity Index, Xc (%) | Amorphous Orientation | Crystal Orientation, fc |
|---|---|---|---|---|---|---|
| Ex2/1 | 421 | 5.4 | α | 21.2 | 0.88 | 0.922 |
| Ex2/2 | 841 | 2.7 | α | 23.8 | 0.76 | 0.932 |
| Ex2/3 | 1261 | 1.8 | α | 20.7 | 0.8 | 0.956 |
| Ex2/4 | 841 | 2.7 | α | 15 | 0.88 | 0.948 |
| Ex2/5 | 1681 | 1.35 | α | 16.7 | 0.8 | 0.949 |
| Ex2/6 | 2522 | 0.9 | α | 24.6 | 0.81 | 0.961 |

Six spinning runs were conducted using the propylene copolymer Ex3. The melt temperature of each run was 220° C., the throughput was 0.6 ghm for Runs 3/1–3 and 0.3 ghm for Runs 3/4–6, and the spinning speed (meters/minute or m/min) was 1000 m/min for Runs 3/1 and 3/4, 2000 m/min for Runs 3/2 and 3/5, and 3000 m/min for Runs 3/3 and 3/6. The data are presented in Table 4.

TABLE 4

SPINNING CONDITONS AND X-RAY CHARACTERIZATION OF EX3 FIBERS

| Run No. | Draw Down | Denier/ Filament | Crystal Type | Crystallinity Index, Xc (%) | Amorphous Orientation | Crystal Orientation, fc |
|---|---|---|---|---|---|---|
| Ex3/1 | 421 | 5.4 | α | 12.2 | 0.88 | 0.926 |
| Ex3/2 | 841 | 2.7 | α | 14.7 | 0.79 | 0.93 |
| Ex3/3 | 1261 | 1.8 | α | 17.1 | 0.74 | 0.936 |
| Ex3/4 | 841 | 2.7 | α | 14 | 0.87 | 0.930 |
| Ex3/5 | 1681 | 1.35 | α | 17.8 | 0.85 | 0.917 |
| Ex3/6 | 2522 | 0.9 | α | 19.9 | 0.76 | 0.93 |

Spinning of Ex1–Ex3 is compared in Table 5. The melt temperature was 220° C., the draw down 1261, and the throughput 0.4 ghm for each run. The spinning speed was 2000 m/min for each run.

TABLE 5

SPINNING CONDITIONS AND X-RAY CHARACTERIZATION OF DIFFERENT EXAMPLES

| Resin | Crystallinity Index (%) | Amorphous Orientation | Crystal Orientation |
|---|---|---|---|
| Ex1/7 | 25.8 | 0.71 | 0.938 |
| Ex2/7 | 12.5 | 0.89 | 0.939 |
| Ex3/7 | 4 | 0.93 | 0.849 |

Comparative examples C1–C3 were run under the same conditions as reported in Tables 2, 3 and 4. The results are presented in Table 6, 7 and 8 respectively.

TABLE 6

SPINNING CONDITIONS AND X-RAY CHARACTERIZATION OF C1 FIBERS

| Run No. | Draw Down | Denier/ Filament | Crystal Type | Crystallinity Index, Xc (%) | Amorphous Orientation | Crystal Orientation, fc |
|---|---|---|---|---|---|---|
| C1/1 | 421 | 5.4 | smectic | 26 | 0.56 | — |
| C1/2 | 841 | 2.7 | α | 47.9 | 0.72 | 0.956 |
| C1/3 | 1261 | 1.8 | α | 52.3 | 0.77 | 0.957 |
| C1/4 | 841 | 2.7 | α | 58.2 | 0.7 | 0.918 |
| C1/5 | 1681 | 1.35 | α | 61.5 | 0.63 | 0.958 |
| C1/6 | 2522 | 0.9 | α | 53.1 | 0.91 | 0.932 |

TABLE 7

SPINNING CONDITIONS AND X-RAY CHARACTERIZATION OF C2 FIBERS

| Run No. | Draw Down | Denier/ Filament | Crystal Type | Crystallinity Index, Xc (%) | Amorphous Orientation | Crystal Orientation, fc |
|---|---|---|---|---|---|---|
| C2/1 | 421 | 5.4 | smectic | — | — | — |
| C2/2 | 841 | 2.7 | α | 38.7 | 0.69 | 0.92 |
| C2/3 | 1261 | 1.8 | — | — | — | — |
| C2/4 | 841 | 2.7 | α | 38.7 | 0.72 | 0.9 |
| C2/5 | 1681 | 1.35 | — | — | — | — |
| C2/6 | 2522 | 0.9 | — | — | — | — |

TABLE 8

SPINNING CONDITONS AND X-RAY CHARACTERIZATION OF C3 FIBERS

| Run No. | Draw Down | Denier/ Filament | Crystal Type | Crystallinity Index, Xc (%) | Amorphous Orientation | Crystal Orientation, fc |
|---|---|---|---|---|---|---|
| C3/1 | 421 | 5.4 | smectic | — | — | — |
| C3/2 | 841 | 2.7 | α | 37.3 | 0.59 | 0.91 |
| C3/3 | 1261 | 1.8 | — | — | — | — |
| C3/4 | 841 | 2.7 | α | 27.5 | 0.59 | 0.87 |
| C3/5 | 1681 | 1.35 | — | — | — | — |

As mentioned before, the most common crystal form for oriented PP is the α, monoclinic form. However, for quenched samples of low orientation (low spinning stress), a less-ordered crystalline form, referred to as paracrystalline, or smectic, also exists. In this crystal structure, the chains are not in a perfect three-dimensional lattice, but have a general two-dimensional order. This smectic crystalline form is achieved by quickly quenching the melt to a temperature below 70° C. If temperatures above 70° C. are applied to a polymer, with a smectic crystal phase, the crystals transform to the more stable alpha form.

It is surprising that, under the spinning conditions of Table 5, the inventive fibers made with Ex2–Ex4 all have the alpha crystal form. Looking at the comparative resin fibers runs, it is seen that, for the C1–C3 resins (Z/N h-PP, Z/N ethylene (Et) random copolymer, and metallocene h-PP) resins spun at low draw down (draw down=421) and relatively slow fiber speed (1000 m/min) (see runs C1/1 and C2/1 and C3/1 in Tables 6, 7, and 8), the smectic structure was found (see C1/1 and C3/1 x-ray diffraction patterns in FIGS. 1A and 1B).

The fiber properties for all inventive and comparative fibers are reported in Table 9.

TABLE 9

FIBER TENSILE AND ELASTIC PROPERTIES FOR SELECTIVE INVENTIVE AND COMPARATIVE EXAMPLES

| Run Number | Modulus (g/den) | Elongation (%) | Tenacity (g/den) | 30% load (g/den) | 30% unload (g/den) | Retained load at 30% (%) | Immediate Set (%) |
|---|---|---|---|---|---|---|---|
| Ex1/1 | 7.14 | 146 | 2.43 | 0.71 | 0.02 | 2.5 | 26 |
| Ex1/2 | 10.95 | 128 | 2.86 | 1.41 | 0.08 | 5.6 | 25 |
| Ex1/3 | 13.00 | 101 | 2.89 | 1.85 | 0.13 | 6.9 | 25 |
| Ex1/4 | 9.72 | 152 | 2.75 | 1.00 | 0.16 | 15.5 | 25 |
| Ex1/5 | 13.98 | 108 | 2.81 | 1.69 | 0.13 | 7.6 | 24 |
| Ex1/6 | 15.84 | 86 | 2.94 | 2.31 | 0.15 | 6.7 | 25 |
| Ex2/1 | 2.14 | 145 | 1.82 | 0.49 | 0.07 | 13.7 | 10 |
| Ex2/2 | 4.06 | 91 | 2.76 | 1.31 | 0.15 | 11.6 | 11 |
| Ex2/3 | 5.85 | 69 | 2.48 | 1.69 | 0.20 | 11.6 | 11 |
| Ex2/4 | 3.46 | 134 | 2.39 | 0.75 | 0.10 | 13.1 | 11 |
| Ex2/5 | 6.89 | 97 | 2.90 | 1.71 | 0.14 | 8.3 | 14 |
| Ex2/6 | 7.72 | 66 | 2.56 | 2.16 | 0.17 | 7.7 | 12 |
| Ex3/1 | 0.14 | 208 | — | 0.20 | 0.05 | 27.7 | 5 |
| Ex3/2 | 1.35 | 120 | 2.31 | 0.70 | 0.13 | 18.3 | 5 |
| Ex3/3 | 2.16 | 91 | 2.27 | 1.03 | 0.15 | 14.9 | 5 |
| Ex3/4 | 0.49 | 151 | 1.87 | 0.40 | 0.09 | 21.8 | 5 |
| Ex3/5 | 2.98 | 89 | 2.20 | 1.01 | 0.15 | 15.1 | 6 |
| Ex3/6 | 1.91 | 112 | 1.89 | 0.14 | 0.03 | 22.0 | 5 |
| C1/1 | 19.36 | 276 | 1.84 | 0.47 | 0.00 | 0.0 | 30 |
| C1/2 | 38.93 | 202 | 1.95 | 1.11 | 0.07 | 6.7 | 19 |
| C1/3 | 50.41 | 188 | 2.35 | 1.44 | 0.11 | 7.9 | 20 |

TABLE 9-continued

FIBER TENSILE AND ELASTIC PROPERTIES FOR SELECTIVE INVENTIVE AND COMPARATIVE EXAMPLES

| Run Number | Modulus (g/den) | Elongation (%) | Tenacity (g/den) | 30% load (g/den) | 30% unload (g/den) | Retained load at 30% (%) | Immediate Set (%) |
|---|---|---|---|---|---|---|---|
| C1/4 | 25.68 | 240 | 2.10 | 1.08 | 0.05 | 5.0 | 16 |
| C1/5 | 37.87 | 215 | 2.15 | 1.38 | 0.11 | 8.1 | 18 |
| C1/6 | 52.48 | 187 | 2.27 | 1.69 | 0.05 | 2.8 | 27 |
| C2/1 | 8.57 | 199 | 2.31 | 0.62 | 0.00 | 0.0 | 29 |
| C2/2 | 16.66 | 161 | 2.56 | 1.23 | 0.01 | 0.9 | 28 |
| C2/3 | 11.42 | 147 | 2.56 | 1.62 | 0.02 | 1.5 | 28 |
| C2/4 | 13.16 | 182 | 2.38 | 0.96 | 0.00 | 0.3 | 29 |
| C2/5 | 16.24 | 166 | 2.35 | 1.33 | 0.03 | 2.2 | 29 |
| C2/6 | 21.65 | 117 | 2.15 | 1.66 | 0.00 | 0.3 | 29 |
| C3/1 | 12.09 | 178 | 2.59 | 0.70 | 0.00 | 0.0 | 33 |
| C3/2 | 19.21 | 115 | 3.52 | 1.75 | 0.00 | 0.0 | 29 |
| C3/3 | 24.88 | 107 | 3.09 | 2.10 | 0.01 | 0.5 | 28 |
| C3/4 | 21.02 | 163 | 3.23 | 1.80 | 0.05 | 0.3 | 28 |
| C3/5 | 26.50 | 112 | 3.00 | 2.37 | 0.02 | 0.9 | 28 |

Plotting the immediate set and moduli of the fibers described in the preceding tables (FIG. 2), there is clear differentiation of the inventive fibers and the comparative examples. Inventive fibers describe a region of lower immediate set (less than about 22%) and of lower modulus (less than about 22 g/den) in contrast to the comparative examples. Functionally, this behavior translates to fibers that are easier to stretch (lower modulus) and fibers that have greater recovery upon deformation (lower immediate set).

FIG. 3 shows that the lower immediate set of the inventive fibers corresponds to crystallinity index regions of less than or equal to about 30%. Furthermore, there is clear differentiation from comparative example C1, which had surprisingly low immediate set.

FIG. 4 shows the moduli corresponding to the crystallinity index region less than or equal to about 30%. The crystallinity index correlates to fiber stiffness measured as fiber modulus, which in turn correlates to nonwoven drape and hand. The fiber stiffness of the inventive polymers is significantly lower than for other propylene polymers and at lower immediate set and therefore should result in differentiated fiber as well as fabric.

FIG. 5 shows the retained load at 30% strain in the 50% 1-cycle test corresponding to the crystallinity index region less than or equal to 30%. Retained load is a measure of retractive force for a give extension force and is an aspect of elasticity. Greater retained loads translate to fibers that have greater "holding power". In many elastic applications, higher holding power is desirable for its greater mechanical ability to fasten one object to another.

FIG. 6 describes the corresponding tenacity of the inventive fibers when pulled to break. Again, crystallinity is shown to be a key factor in tenacity. Surprisingly, lower crystallinity propylene-ethylene copolymer fibers could match or exceed the tenacity of many higher crystallinity propylene fibers (Table 9).

Examination of propylene-ethylene fibers melt spun under a variety of conditions revealed that comonomer (ethylene) content, spinning speed and quench condition were the prime determining factors that affected crystallinity index and in turn, tensile and elastic properties, as is demonstrated above. The crystallinity index can be seen to increase with increased spinning speed and reduced throughput. This effect is typical for stress-induced crystallization, and surprisingly the effect decreases with increased ethylene content.

Consideration of property balances allows further differentiation of the inventive examples. Plotting immediate set against retained load at 30% strain (FIG. 8) shows a transition to very low set with retained loads at 30 % strain of about 15% and greater. These coincide with fibers having a crystallinity index of about 20% and lower (FIG. 5). Consequently, fibers with less than about 20% crystallinity index describe elastic performance characterized by greater recovery (lower immediate set) and by higher retractive force (higher retained load). The subset of the inventive fibers with less than 10% crystallinity index can be classified as elastic fiber.

Based on the described discoveries, the following table of preferred ranges for the fibers of this invention is described (Table 10).

TABLE 10

PREFERRED RANGES FOR THE INVENTIVE FIBERS

| | Extensible | Intermediate A | Intermediate B | Elastic |
|---|---|---|---|---|
| Ethylene (wt. %) | (greater than 5) to 17 | 6 to 17 | 7 to 17 | 9 to 17 |
| Crystallinity Index (%) | less than 30 | less than 27 | less than 23 | less than 20 |
| Immediate Set (50% 1-Cycle Test) | less than 22 | less than 18 | less than 14 | less than 10 |
| Modulus (g/den) | less than 22 | less than 18 | less than 14 | less than 10 |
| Tenacity (g/den) | greater than 1.2 | greater than 1.2 | greater than 1.2 | greater than 1.2 |

TABLE 10-continued

| PREFERRED RANGES FOR THE INVENTIVE FIBERS | | | | |
|---|---|---|---|---|
| | Extensible | Intermediate A | Intermediate B | Elastic |
| Retained Load at 30% (50% 1-Cycle Test) | greater than 2.5 | greater than 7 | greater than 11 | greater than 15 |
| Elongation | ≧50 | ≧50 | ≧50 | ≧50 |

Thirty four g/m$^2$ (1 ounce per square yard (osy)) spunbond nonwovens were produced from the Ex2 and Ex3 resins on a 14" pilot line using a 25 holes per inch (hpi) spin pack with a distance between the spin pack and the fiber drawing unit of 48 inches. The polymer was run at 0.6 ghm at a melt temperature of 390° F. (199° C.). Quench air flow (100 feet/min) and temperature (70° F.) was applied over a distance of 25 inches. The drawing pressure in the fiber draw unit was 4 psi. After collecting the fibers on the belt, the nonwovens were bonded using an average pattern roll/anvil roll temperature of 130° F. (55° C.). The average fiber size of these webs was about 30 microns. The properties of the nonwovens are presented in Table 11 as examples 4/1 and 4/2. The web homogeneity of the inventive fabrics is excellent as evidenced by the low number of filament aggregates per linear 2 cm.

For example 4/3, a 34 g/m$^2$ spunbond nonwoven was produced from the Ex2 polymer on a 14" pilot line using a 50 holes per inch (hpi) spin pack with a distance between the spin pack and the fiber drawing unit of 50 inches. The polymer was run at 0.7 ghm at a melt temperature of 490° F. (255° C.). Quench air flow of 100 feet/min and temperature of 77° F. was applied over a distance of 25 inches. The drawing pressure in the fiber draw unit was 6 psi. After collecting the fibers on the belt, the nonwovens were bonded using an average pattern roll/anvil roll temperature of 130° F. (55C). The properties of this nonwoven are also presented in Table 11. The web homogeneity of this nonwoven is not acceptable as demonstrated by the unacceptably high number of filament aggregates.

Comparative Example C4/1 is a commercially available hPP based nonwoven of 15 g/m$^2$ (0.45 osy).

TABLE 11

| NONWOVEN PROPERTIES | | | | |
|---|---|---|---|---|
| Test | Ex4/1 (25MFR, 9 wt % E) | Ex4/2 (25MFR, 12 wt % E) | Ex4/3 (25 MFR 9 wt % E) | C4/1 (38 MFR, 0 wt % E) |
| Basis weight, g/m$^2$ (osy) | 30.4 (0.893) | 33.5 (0.984) | 33.5 (0.986) | 15.3 (0.45) |
| Peak Tensile Load, MD, g | 3920 | 3580 | 2530 | 6121* |
| Peak Tensile Load, CD, g | 1500 | 990 | 645 | 1724* |
| Peak Elongation, MD, % | 168 | 225 | 174 | 43* |
| Peak Elongation, CD, % | 277 | 422 | 217 | 69* |
| Set, MD, % | 26 | — | 30 | NA |
| Set, CD, % | 33 | 19 | 38 | NA |
| Hysteresis loss, MD, % | 73 | — | 77 | NA |
| Hysteresis loss, CD, % | 72 | 45 | 76 | NA |
| Load down, MD, gF | 329 | — | 198 | NA |

TABLE 11-continued

| NONWOVEN PROPERTIES | | | | |
|---|---|---|---|---|
| Test | Ex4/1 (25MFR, 9 wt % E) | Ex4/2 (25MFR, 12 wt % E) | Ex4/3 (25 MFR 9 wt % E) | C4/1 (38 MFR, 0 wt % E) |
| Load down, CD, gF | 83 | 78 | 36 | NA |
| Crystallinity Index, % | 14.0 | 9.8 | — | — |
| Number of filament aggregates per 2 cm | 17 | 29 | 40 | 0 |

*data normalized to 1 osy;
NA: not available for measurement as webs fail at about 60% strain The data show that both the inventive polymers and the webs made from them are elastic. The crystallinity index, Xc, measured on fibers in a nonwoven web in between the bond points, is below 20%. The inventive nonwovens are anisotropic in nature (not due to the nature of the polymer, but rather to non optimized fabrication conditions).

As seen from a comparison between Examples 4/1, 4/2, and 4/3, the processing conditions also play a role in producing a satisfactory nonwoven. For a given spin pack density and quench air temperature, only certain combinations of throughput and residence time of the fiber between the spin pack and the fiber drawing unit, the melt temperature and the quench air flow rate will lead to more homogeneous web formation.

Nonwoven fabrics of Ex4/2 are made of predominantly individual unmarried filaments. However, such filaments are self-bonding as evidenced by the micrograph of FIG. 9. The bond points occur at fiber-fiber contacts, and they are about 5 to 50 μm in length. Conventional, mechanically made bond points, e.g., those achieved by a patterned calendar roll, are much larger (100's–1000's microns) in size and consequently, they cannot match the density of self-bonding points. Furthermore, the large film-like bond points and the resulting increase in fabric stiffness and drape degrade hand feel. In this way, self-bonding has at least three advantages over mechanical bonding, i.e., simplicity in manufacture, better fabric drape and better hand feel.

While this invention has been described in considerable detail by the preceding examples, this detail was provided for the purpose of illustration only and is not to be construed as a limitation upon the invention as described in the following claims. All U.S. patents and allowed U.S. patent applications cited above are incorporated herein by reference.

What is claimed is:

1. An extensible fiber comprising a propylene copolymer, the copolymer comprising at least about 50 weight percent of units derived from propylene and at least about 5 weight percent of units derived from a comonomer other than propylene, the fiber characterized as having a crystallinity index less than 30%, a modulus of less than or equal to about 22 g/den, wherein said extensible fiber can be characterized by having a retained load of more than or equal to about 2.5% and an immediate set of less than or equal to about 22% as determined in a 50% 1-cycle test, said 50% 1-cycle test being one in which a load on the fiber is measured while the fiber is extended at a rate of 10 inches per minute to an elongation of 50% then retracted to an elongation of 0% at a rate of 10 inches per minute, and then extended a second time to an elongation of 50% at a rate of 10 inches per minute, and wherein the retained load is the load measured at 30% elongation during retraction divided by the load measured at 30% elongation during the first extension, and wherein the immediate set is the elongation at which a positive load is first measured during the second extension.

2. The extensible fiber of claim 1 wherein the crystallinity index less than 20%, the modulus is less than or equal to about 10 g/den, the retained load is more than or equal to about 15%, and the immediate set is less than or equal to about 10%.

3. The fiber of claims 1 or 2 in which the copolymer comprises at least about 84 weight percent of units derived from propylene, and the comonomer other than propylene is ethylene.

4. The fiber of claim 1 or 2 which the propylene copolymer has at least one of the following characteristics:

(i) $^{13}C$ NMR peaks corresponding to a regio-error at about 14.6 and about 15.7 ppm, the peaks of about equal intensity; or (ii) a DSC curve with a $T_{mc}$ that remains essentially the same and a $T_{max}$ that decreases as the amount of the comonomer in the copolymer is increased; or (iii) an X-ray diffraction pattern exhibiting more gamma-form crystals than a propylene copolymer comparable in weight average molecular weight except that it is prepared with a Ziegler-Natta catalyst.

5. The fiber of claim 1 in which the fiber is not annealed.

6. The fiber of claim 4 which exhibits an elongation to break of less than or equal to 300%.

7. An extensible nonwoven fabric comprising the fibers of claim 1.

8. The extensible nonwoven fabric of claim 7 further characterized in that the fibers were melt extruded, pneumatically drawn.

9. The extensible nonwoven fabric of claim 8 wherein the fabric is selected from the group consisting of spunbond nonwoven fabric and meltblown nonwoven fabric.

10. A nonwoven fabric as in claim 9 having a first cycle set less than about 40% at 80% strain.

11. A nonwoven fabric as in claim 9 having a first cycle set less than about 15% at 80% strain.

12. An extensible laminate comprising a nonwoven fabric of claim 9.

13. A personal care product comprising a nonwoven fabric of claim 9.

14. A personal care product comprising the extensible laminate of claim 12.

15. An article comprising the fiber of claim 1.

16. The article of claim 15 wherein to article is fabricated into a nonwoven and is selected from the group consisting of personal care products like disposable diapers, swim pants, incontinent wear, feminine hygiene products, veterinary products, bandages, items of health care such as surgeon's gowns, surgical drapes, sterilization wrap and to like, and home furnishing such as bedding wipes, and the like.

17. The article of claim 16 wherein the nonwoven is part of a composite.

18. An extensible nonwoven comprised of the fibers of claim 1 wherein the fiber is a homofilament fiber and the nonwoven has fewer than 20 filament aggregates per 2 cm.

19. The nonwoven of claim 18 which is elastic.

20. An extensible nonwoven fabric of claim 18 or 19 further characterized in that the fibers were melt extruded, pneumatically drawn and wherein the fabric is selected from the group consisting of spunbond nonwoven fabric and meltblown nonwoven fabric.

21. A nonwoven fabric as in claim 20 having a first cycle set less than about 40% at 80% strain.

22. A nonwoven fabric as in claim 21 having a first cycle set less than about 15% at 80% strain.

23. An extensible laminate comprising a nonwoven fabric of claim 20.

24. A personal care product comprising a nonwoven fabric of claim 20.

25. The nonwoven of any one of claims 7–11 and 18–19, wherein the nonwoven is spunbond and wherein at least a portion of the fibers are bonded to other fibers over a distance which is less than 10 times the diameter of the thickest fiber, without using any additional bonding method.

26. A fiber of claim 1, wherein the fiber comprises smectic regions.

* * * * *